US011637374B2

(12) United States Patent
Hong et al.

(10) Patent No.: US 11,637,374 B2
(45) Date of Patent: Apr. 25, 2023

(54) ANTENNA WITH FERRITE-CORE AND DIELECTRIC-SHELL

(71) Applicant: The Board of Trustees of The University of Alabama, Tuscaloosa, AL (US)

(72) Inventors: Yang-Ki Hong, Tuscaloosa, AL (US); Woncheol Lee, Seoul (KR); Hoyun Won, Tuscaloosa, AL (US)

(73) Assignee: The Board of Trustees of The University of Alabama, Tuscaloosa, AL (US)

( * ) Notice: Subject to any disclaimer, the term of this patent is extended or adjusted under 35 U.S.C. 154(b) by 150 days.

(21) Appl. No.: 16/876,180

(22) Filed: May 18, 2020

(65) Prior Publication Data

US 2020/0365991 A1 Nov. 19, 2020

Related U.S. Application Data

(60) Provisional application No. 62/849,267, filed on May 17, 2019.

(51) Int. Cl.
*H01Q 7/08* (2006.01)
*H01Q 11/08* (2006.01)

(52) U.S. Cl.
CPC ..... *H01Q 7/08* (2013.01); *H01Q 11/08* (2013.01)

(58) Field of Classification Search
CPC ..... H01Q 7/08; H01Q 11/08
See application file for complete search history.

(56) References Cited

U.S. PATENT DOCUMENTS 6,150,994 A * 11/2000 Winter ..... H01Q 21/30 343/895
2005/0023501 A1* 2/2005 Ishida ..... H01F 41/0246 252/62.62
2015/0022410 A1* 1/2015 Yamada ..... H01F 1/15316 343/788

FOREIGN PATENT DOCUMENTS

JP 2009253543 A * 10/2009
JP 2011114853 A * 6/2011

OTHER PUBLICATIONS

Lee, "Lossy Ferrite Core-Dielectric Shell Structure for Miniature GHz Axial-Mode Helical Antenna", IEEE Antennas and Wireless Propagation Letters (vol. 18, Issue: 5, May 3, 2019). (Year: 2019).*
L. Liu, Y. Li, Z. Zhang, Z. Feng, "Circularly Polarized Patch-Helix Hybrid Antenna with Small Ground," IEEE Antennas Wireless Propag. Lett., vol. 13, pp. 361-364, 2014.
(Continued)

*Primary Examiner* — Dieu Hien T Duong
(74) *Attorney, Agent, or Firm* — Meunier Carlin & Curfman LLC

(57) ABSTRACT

In an aspect, the disclosed technology relates to embodiments of a lossy ferrite-core and dielectric-shell (LFC-DS) structure in an axial-mode helical antenna (AM-HA) or a meandered dipole antennas. The instant topology can be used to facilitates the broader use of ferrite materials, including lossy ferrite material, for a miniature AM-HA or meandered dipole antennas, e.g., by overcoming the lossy characteristics of the lossy ferrite. The resulting miniature AM-HA can be used for high frequency operation, including at over 1 GHz, making the instant topology suitable for very high frequency (VHF) and ultra-high Frequency (UHF) applications.

19 Claims, 20 Drawing Sheets

(56) References Cited

OTHER PUBLICATIONS

N. Neveu, Y.-K. Hong, J. Lee, J. Park, G. S. Abo, W. Lee, and D. Gillespie, "Miniature Hexaferrite Axial-Mode Helical Antenna for Unmanned Aerial Vehicle Applications," IEEE Trans. Magn., vol. 49, p. 4265-4268, 2013.

H. Nakano, H. Takeda, T. Honma, H. Mimaki, and J. Yamauchi, "Extremely Low-Profile Helix Radiating a Circularly Polarized Wave," IEEE Trans. Antennas Propag., vol. 39, No. 6, pp. 754-757, Jun. 1991.

H. T. Hui, K. Y. Chan, and E. K. N. Yung, "The Low-Profile Hemispherical Helical Antenna with Circular Polarization Radiation Over a Wide Angular Range," IEEE Trans. Antennas Propag., vol. 51, No. 6, pp. 1415-1418, Jun. 2003.

A. H. Safavi-Naeini and O. Ramahi, "Miniaturizing the Axial Mode Helical Antenna," in Proc. IEEE Conf. Communications and Electronics, ICCE, Jun. 2008, pp. 374-379.

I. Ghoreishian and A. Safaai-Jazi, "A New Doubly Helical Antenna," Micro. Opt. Technol. Lett., vol. 57, No. 10, pp. 2351-2355, Oct. 2015.

T. A. Latef and S. K. Khamas, "Measurement and Analysis of a Helical Antenna Printed on a Layered Dielectric Hemisphere," IEEE Trans. Antennas Propag., vol. 59, No. 12, pp. 4831-4835, Dec. 2011.

W. Coburn, C. Ly, T. Burcham, R. Harris, and A. Bamba, "Design and Fabrication of an Axial Mode Helical Antenna," Appl. Comput. Electromagn. Soc. J., vol. 24, No. 6, pp. 559-566, Dec. 2009.

W. Lee, Y.-K. Hong, J. Lee, D. Gillespie, K. G. Ricks, F. Hu, and J. Abu-Qahouq, "Dualpolarized Hexaferrite Antenna for Unmanned Aerial Vehicle (UAV) Applications," IEEE Antennas Wireless Propag. Lett., vol. 12, pp. 765-768, 2013.

W. Lee, Y.-K. Hong, M. Choi, H. Won, J. Lee, G. LaRochelle, and S. Bae, "Figure of Merit of W-type BaCo1.4Zn0.6Fe16O27 Hexaferrite for Gigahertz Device Applications," IEEE Magn. Lett., vol. 8, p. 5109204, 2017.

W. Lee, Y.-K. Hong, J. Park, G. LaRochelle, and J. Lee, "Low-loss Z-type Hexaferrite (Ba3Co2Fe24O41) for GHz Antenna Applications," J. Magn. Magn. Mater., vol. 414, pp. 194-197, Sep. 2016.

S. Ahn and H. Choo, "A systematic design method of on-glass antennas using mesh-grid structures," IEEE Trans. Veh. Technol., vol. 59, No. 7, pp. 3286-3293, 2010.

S. Ahn, Y. Cho, and H. Choo, "Diversity on-glass antennas for maximized channel capacity for FM radio reception in vehicles," IEEE Trans. Antennas Propag., vol. 59, No. 2, pp. 699-702, Feb. 2011.

G. Byun, Y. G. Noh, I. M. Park, and H. S. Choo, "Design of rear glass-integrated antennas with vertical line optimization for fm radio reception," Int. J. Automotive Technol., vol. 16, No. 4, pp. 629-634, Aug. 2015.

W. Kang and H. Choo, "Design of vertical lines for vehicle rear window antennas," Microw. Opt. Technol. Lett., vol. 52, No. 6, pp. 1445-1449, Jun. 2010.

Y. Noh, Y. Kim, and H. Ling, "Broadband on-glass antenna with meshgrid structure for automobiles," Electron. Lett., vol. 41, No. 21, pp. 1148-1149, Oct. 2005.

G. Byun, C. Seo, B.-J. Jang, and H. Choo, "Design of aircraft on-glass antennas using a coupled feed structure," IEEE Trans. Antennas Propag., vol. 60, No. 4, pp. 2088-2093, Apr. 2012.

S. Ahn, S. Park, Y. Noh, D. Park, and H. Choo, "Design of an On-glass Vehicle Antenna Using a Multiloop Structure," Microw. Opt. Technol. Lett., vol. 52, No. 1, p. 107, 2010.

Y. Bai, W. Zhang, L. Qiao, and J. Cao, "Engineering Soft Magnetic Properties by Doping Ions in Low-filed M-type Hexaferrite with Bi—Co—Ti substitution," RSC Adv., vol. 5, p. 91382, 2015.

J. Lee, Y.-K. Hong, S. Bae, J. Jalli, and G. S. Abo, "Low loss Co2Z (Ba3Co2Fe24O41)-glass Composite for Gigahertz Antenna Application," J. Appl. Phys., vol. 109, p. 07E530, 2011.

J. D. Kraus, "A 50-Ohm Input Impedance for Helical Beam Antennas," IEEE Trans. Antennas Propag., vol. AP-25, No. 6, p. 913, Nov. 1977.

B. D. Cullity and C. D. Graham, Introduction to Magnetic Materials, 2nd ed., Hoboken, NJ: Wiley, 2009, p. 417.

* cited by examiner

| $r_{DRD}$ | $w_1$ | $w_2$ | $\alpha$ | $d_c$ | $T_{FM}$ |
|---|---|---|---|---|---|
| 50 mm | 2.9 mm | 1.04 mm | 57.3° | 0.812 mm | 1.5 mm |
| | | | Ferrite-core and ferrite-core/dielectric-shell | | |
| | | | $r_h$ | $s$ | $h$ |
| | | | 13.6 mm | 23 mm | 69 mm |

| $L_A$ | $S_W$ | $P_L$ | $S_L$ |
|---|---|---|---|
| 240" | 255" | 7 | 55" |
| $S_W$ | $G_L$ | $G_W$ | $h_s$ |
| 11 | 778" | 808" | 175" |
| | | 93.5" | 1.4 |

Units in mm

*Without ferrite layer and **With ferrite layer

ANTENNA WITH FERRITE-CORE AND DIELECTRIC-SHELL

RELATED APPLICATION

This application claims priority to, and the benefit of, U.S. Provisional Patent Application No. 62/849,267, filed May 17, 2019, entitled "Antenna with Ferrite-Core and Dielectric-Shell," which is incorporated by reference herein in its entirety.

BACKGROUND

Axial-mode helical antennas (AM-HAs) are attractive candidates for vehicular applications—e.g., radar, satellite, unmanned aerial vehicle (UAV), and mobile systems—due in part to their radiation characteristics such as end-fire radiation and circular polarization. However, the large volume (V) of AM-HAs have limited their use in such applications.

Different antenna structure have been considered to miniaturize (reduce the volume V of) an AM-HA design: adjusting number of turns and pitch angle of the antenna radiator [3]; using hemispherical winding configuration for the radiator leads [4]; using a periodic sinusoidal patterned radiator and a double helical structured radiator [5, 6]. Further, use of dielectric or magnetic core loaded onto the center of the helical radiators have been considered to miniaturize AM-HAs [2, 7, 8]. In Latef and Khamas (2011) [7], it was observed that the use of high dielectric material facilitates the design of a miniature AM-HA for low operation frequency (e.g., having a voltage standing wave ratio (VSWR) of 2:1; and an axial ratio (AR) under 3 dB), but the use the high permittivity material reduce the axial ratio (AR) bandwidth (BW). In Neveu et al. (2013) [2], it was observed that the use of specialty material such as Z-type $Co_2Z$ hexaferrite-glass composite ($Co_2Z$-HGC) core can also facilitate the design of a miniature AM-HA (providing a miniaturization factor ($n=(\varepsilon_r \cdot \mu_r)^{0.5}$), but magnetic loss was high (e.g., high magnetic loss due to low magnetic loss tangent, tan $\delta_\mu=0.08$), which affected the realized gain (RG) of the resulting AM-HA.

Ferrite material selection for vehicular antennas can be limited to a few material due to requirements for high performance operation at high frequency operation. Frequency modulation (FM) radio has fundamental component between 88 MHz and 108 MHz. Applications such as 5G, high-speed connectivity, and autonomous driving require even high frequency operations, many in the GHz range. In [10], a lower tan $\delta_\mu$ of 0.05 (with $\mu_r$ of 2.1 at 2.2 GHz) was reported but the magnetic loss of the resulting antenna was still too high for use in GHz-based application. In [10, 11], it was reported that ferrite is magnetically lossy at ultra-high frequency (UHF) due to the ferromagnetic resonance (FMR).

In Ahn and Choo (2011) [12], a whip antenna comprising multi-section normal mode spiral structure with variable pitch angle for multi-frequency multi-function operation was developed for FM broadcast reception. In Ahn et al. (2011) [13], a monopole antenna (compact printed spiral monopole antenna) integrable to a shark fin module was designed. As rooftop or radio mast antenna, the whip antenna and shark fin module compromise aesthetic appearance, reduces durability and increases wind noise characteristics. In Byun et al. (2012) [17], glass-integrated strip antennas were designed that directly print as horizontal and vertical lines in the rear and quarter window. The on-glass antenna is large in size and suffers from low gain (e.g., high dielectric loss (tan $\delta_\varepsilon$) in being encapsulated in glass) and high resistance (~0.5 Ω/m).

Therefore, what are needed are devices, systems and methods that overcome challenges in the present art, some of which are described above.

SUMMARY

In an aspect, the disclosed technology relates to embodiments of a lossy ferrite-core and dielectric-shell (LFC-DS) structure in an axial-mode helical antenna (AM-HA) or a meandered dipole antennas. The instant topology can be used to facilitates the broader use of ferrite materials, including lossy ferrite material, for a miniature AM-HA or meandered dipole antennas, e.g., by overcoming the lossy characteristics of the lossy ferrite. The resulting miniature AM-HA can be used for high frequency operation, including at over 1 GHz, making the instant topology suitable for very high frequency (VHF) and ultra-high Frequency (UHF) applications.

In an aspect, an antenna is disclosed that includes a ferrite-dielectric composite structure (e.g., hollow or solid) comprising a ferrite layer (e.g. lossy ferrite layer) and a dielectric layer; and a radiator comprising a conductor placed in proximity the composite structure to form the antenna with the composite structure, wherein the dielectric layer is configured to reduce lossy characteristics of the ferrite layer.

In some embodiments, the conductor of the radiator is helically wounded to form a helix that wraps around the composite structure, wherein the composite structure forms a single shell, wherein the single shell comprises a core as the ferrite layer, and wherein the single shell comprises a shell as the dielectric layer.

In some embodiments, the composite structure forms a multi-shell composite structure, wherein the multi-shell composite structure comprises a first shell member comprising a first ferrite layer surrounded by a first dielectric electric layer, and wherein the multi-shell composite structure comprises a second shell member comprising a second ferrite layer surrounded by a second dielectric layer, wherein the second shell member surrounds the first shell member.

In some embodiments, the multi-shell composite structure comprises one or more additional N shell members each comprising a ferrite layer surrounded by a dielectric layer, wherein at least one of the one or more additional N shell members surrounds the second shell member.

In some embodiments, the composite structure and radiator forms an axial-mode helical antenna.

In some embodiments, the antenna further includes a substrate, wherein the substrate comprises a quarter-wave transmission line, wherein the radiator is configured to be electrically coupled to the quarter-wave transmission line.

In some embodiments, the dielectric layer has a first shape and the ferrite layer has a second shape, wherein the first shape is different from the second shape.

In some embodiments, the ferrite layer is in contact with the dielectric layer.

In some embodiments, the dielectric layer forms an air gap with the ferrite layer.

In some embodiments, the dielectric layer forms an air gap with the ferrite layer.

In some embodiments, a second dielectric layer is located between the dielectric layer and the ferrite layer.

In some embodiments, the ferrite layer comprise a material selected from the group consisting of a spinel ferrite, a hexagonal ferrite, a ferrite composite, and a soft magnetic material having permeability higher than 1.

In some embodiments, the dielectric layer comprise a material selected from the group consisting of acrylonitrile butadiene styrene, polyactic acid, polyvinyl alcohol, glass, an organic material having permittivity higher than 1, an inorganic material having permittivity higher than 1, and a metallic material having permittivity higher than 1.

In some embodiments, the substrate comprises a material selected from the group consisting of plastic (e.g. Bakelite), glass-reinforced epoxy laminate sheets (e.g. FR-4), glass-reinforced hydrocarbon/ceramic laminates (e.g. R04003), glass microfiber reinforced PTFE composite, and a glass having permeability higher than 1.

In some embodiments, the composite structure has a shape selected from the group consisting of a cylinder, a cone, a sphere, a cuboid, a triangular prism, a pyramid, and a triangular-based pyramid, a hexagonal prism, a polygonal prism, and a polygonal pyramid.

In some embodiments, the ferrite core has a dielectric loss tangent (tan δεE) of at most 0.08 (e.g., equal to or less than 0.08).

In another aspect, an axial-mode helical antenna is disclosed. The axial-mode helical antenna includes a composite structure comprising one or more ferrite layers (e.g. lossy ferrite layer) and one or more dielectric layers, including a first ferrite layer and a first dielectric layer, wherein the first dielectric layer surrounds the first ferrite layer; and a radiator comprising a conductor that helically wound around the composite structure, wherein the one or more dielectric layers are configured to reduce collective lossy characteristics of the one or more ferrite layer.

In another aspect, a meandered dipole antenna is disclosed. The meandered dipole antenna includes a composite structure comprising one or more ferrite layers (e.g. lossy ferrite layer) and one or more dielectric layers, including a first ferrite layer and a first dielectric layer; a radiator comprising a meandered conductor, wherein the radiator is placed next to the first dielectric layer; and a second dielectric layer, wherein the first dielectric layer and second dielectric layer encapsulates the radiator, wherein the one or more dielectric layers are configured to reduce collective lossy characteristics of the one or more ferrite layer.

In another aspect, a method is disclosed to configure an antenna. The method includes providing a lossy ferrite core (or a non-lossy ferrite core) for the antenna; placing a dielectric layer in proximity to the ferrite core to form an antenna core, wherein the dielectric layer has a dielectric loss tangent (tan $\delta_\varepsilon$) less than that of the lossy ferrite core; and assembling a conductive radiator for the antenna in proximity to the antenna core, wherein the lossy ferrite core, dielectric layer, and conductive radiator formed the antenna, and wherein the dielectric layer reduces an effective lossy characteristics of the ferrite core.

In some embodiments, the conductor of the radiator is helically wounded around the composite structure, wherein the composite structure forms a single shell, wherein the single shell comprises a core as the ferrite layer, and wherein the single shell comprises a shell as the dielectric layer.

In some embodiments, the composite structure forms a multi-shell composite structure, wherein the multi-shell composite structure comprises a first shell member comprising a first ferrite layer surrounded by a first dielectric electric layer, and wherein the multi-shell composite structure comprises a second shell member comprising a second ferrite layer surrounded by a second dielectric layer, wherein the second shell member surrounds the first shell member.

In some embodiments, the multi-shell composite structure comprises one or more additional N shell members each comprising a ferrite layer surrounded by a dielectric layer, wherein at least one of the one or more additional N shell members surrounds the second shell member.

In some embodiments, the composite structure and radiator forms an axial-mode helical antenna.

In some embodiments, the antenna further includes a substrate, wherein the substrate comprises a quarter-wave transmission line, wherein the radiator is configured to be electrically coupled to the quarter-wave transmission line.

In some embodiments, the dielectric layer has a first shape and the ferrite layer has a second shape, wherein the first shape is different from the second shape.

In some embodiments, the ferrite layer is in contact with the dielectric layer.

In some embodiments, the dielectric layer forms an air gap with the ferrite layer.

In some embodiments, the dielectric layer forms an air gap with the ferrite layer.

In some embodiments, a second dielectric layer is located between the dielectric layer and the ferrite layer.

In some embodiments, the ferrite layer comprise a material selected from the group consisting of a spinel ferrite, a hexagonal ferrite, a ferrite composite, and a soft magnetic material having permeability higher than 1.

In some embodiments, the dielectric layer comprise a material selected from the group consisting of acrylonitrile butadiene styrene, polyactic acid, polyvinyl alcohol, glass, an organic material having permittivity higher than 1, an inorganic material having permittivity higher than 1, and a metallic material having permittivity higher than 1.

In some embodiments, the substrate comprises a material selected from the group consisting of plastic (e.g. Bakelite), glass-reinforced epoxy laminate sheets (e.g. FR-4), glass-reinforced hydrocarbon/ceramic laminates (e.g. R04003), glass microfiber reinforced PTFE composite, and a glass having permeability higher than 1.

In some embodiments, the composite structure has a shape selected from the group consisting of a cylinder, a cone, a sphere, a cuboid, a triangular prism, a pyramid, and a triangular-based pyramid, a hexagonal prism, a polygonal prism, and a polygonal pyramid.

In some embodiments, the ferrite core has a dielectric loss tangent (tan δεE) of at most (e.g., equal to or less than 0.08).

BRIEF DESCRIPTION OF THE DRAWINGS

The accompanying drawings, which are incorporated in and constitute a part of this specification, illustrate embodiments and together with the description, serve to explain the principles of the methods and systems.

DETAILED DESCRIPTION

Figure 1:
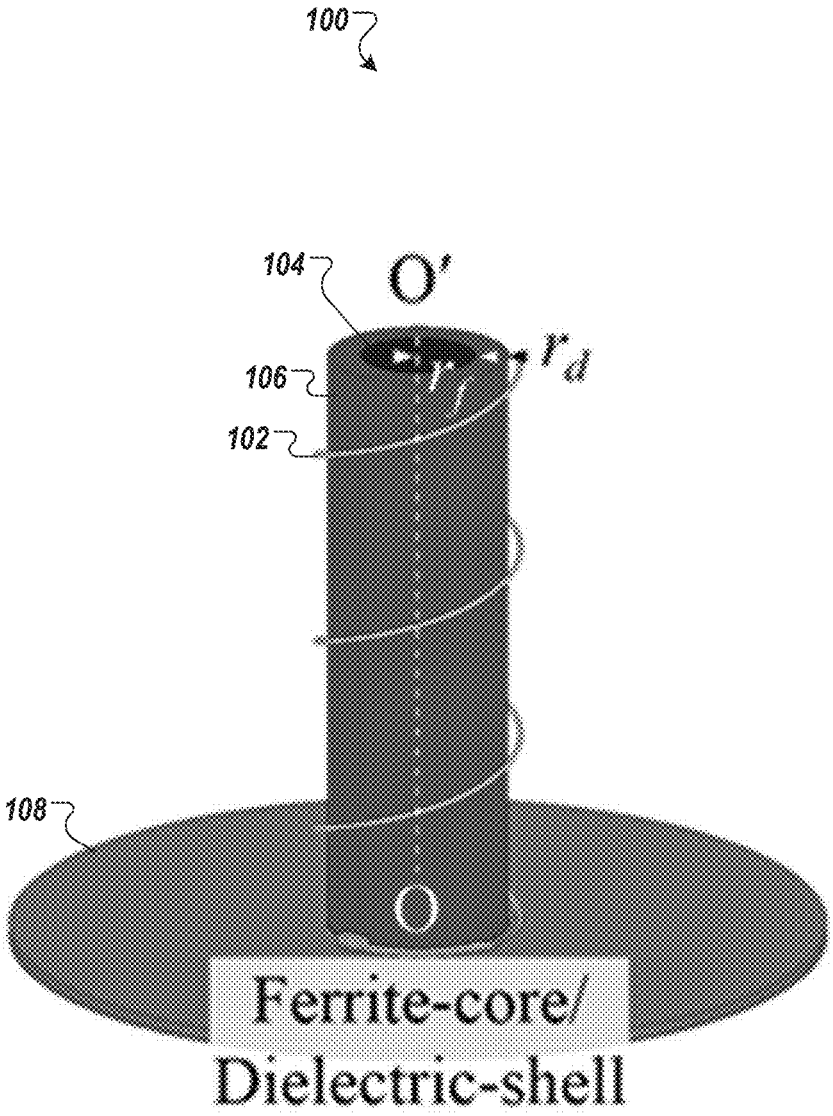
FIG. 1 is a diagram of an antenna that includes a helix-wounded radiator that is wounded around a ferrite-dielectric composite structure that includes one or more ferrite layers and one or more dielectric layers 106 in accordance with an illustrative embodiment.

In some aspects, the disclosed technology relates to a lossy ferrite-core and dielectric-shell (LFC-DS) composite structure for use in an antenna. Although example embodiments of the disclosed technology are explained in detail herein, it is to be understood that other embodiments are contemplated. Accordingly, it is not intended that the disclosed technology be limited in its scope to the details of construction and arrangement of components set forth in the following description or illustrated in the drawings. The disclosed technology is capable of other embodiments and of being practiced or carried out in various ways.

It must also be noted that, as used in the specification and the appended claims, the singular forms "a," "an" and "the" include plural referents unless the context clearly dictates otherwise. Ranges may be expressed herein as from "about" or "approximately" one particular value and/or to "about" or "approximately" another particular value. When such a range is expressed, other exemplary embodiments include from the one particular value and/or to the other particular value.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose. It is also to be understood that the mention of one or more steps of a method does not preclude the presence of additional method steps or intervening method steps between those steps expressly identified. Steps of a method may be performed in a different order than those described herein without departing from the scope of the disclosed technology. Similarly, it is also to be understood that the mention of one or more components in a device or system does not preclude the presence of additional components or intervening components between those components expressly identified.

Some references, which may include various patents, patent applications, and publications, are cited in a reference list and discussed in the disclosure provided herein. The citation and/or discussion of such references is provided merely to clarify the description of the disclosed technology and is not an admission that any such reference is "prior art" to any aspects of the disclosed technology described herein. In terms of notation, "[n]" corresponds to the nth reference in the list. For example, [20] refers to the 20th reference in the list, namely [20]J. Lee, Y.-K. Hong, S. Bae, J. Jalli, and G. S. Abo, "Low loss $Co_2Z$ (Ba3Co2Fe24O41)-glass Composite for Gigahertz Antenna Application," J. Appl. Phys., vol. 109, p. 07E530, 2011. All references cited and discussed in this specification are incorporated herein by reference in their entireties and to the same extent as if each reference was individually incorporated by reference.

In the following description, references are made to the accompanying drawings that form a part hereof and that show, by way of illustration, specific embodiments or examples. In referring to the drawings, like numerals represent like elements throughout the several figures.

FIG. 1 is a diagram of an antenna 100 that includes a helix-wounded radiator 102 that is wounded around a ferrite-dielectric composite structure that includes one or more ferrite layers 104 and one or more dielectric layers 106 in accordance with an illustrative embodiment. The radiator 102 and composite structure (104, 106) form the antenna and are mounted to a substrate 108. In some embodiments, the ferrite layers 104 is made of a lossy ferrite material, and the dielectric layer 106 when coupled with the ferrite layer 104 is configured to reduce the lossy characteristics of the ferrite layer.

Figure 2:
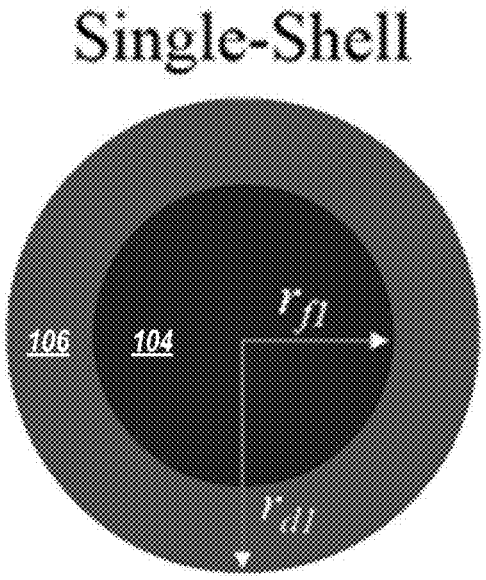
FIG. 2 shows a top view of a single shell composite structure in accordance with an illustrative embodiment.

As shown in FIG. 1, the conductor of the radiator 102 is a long wire that is helically wounded around the composite structure (104, 106). The composite structure (104, 106) can be configured as a single shell structure having a single ferrite layer (104) and a single shell dielectric layer (106). FIG. 2 shows a top view of a single shell composite structure in accordance with an illustrative embodiment. In FIG. 2, the first dielectric layer 106 (having outer radius $r_{d1}$) surrounds a first ferrite layer 104 (having outer radius $r_{f1}$) to form an inner composite structure. The radiator may be made of copper and may be configured as an insulated wire. The composite structure (104, 106) can also be configured as a multi-shell structure having multiple ferrite layers (104) and multiple shell dielectric layers (106).

Figure 3:
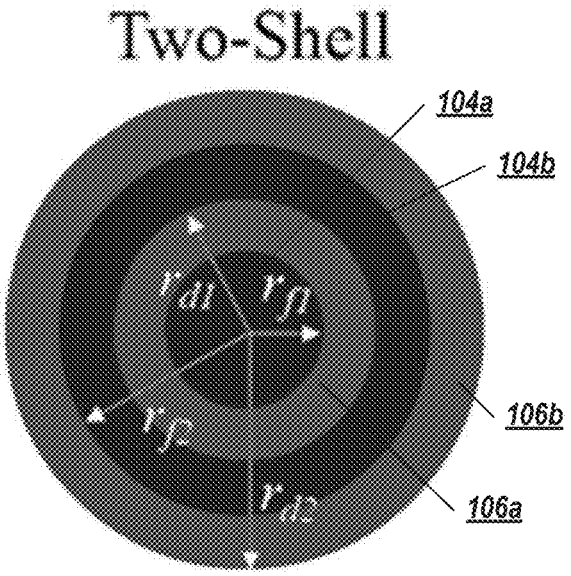
FIG. 3 shows a top view of a multi-shell composite structure having two ferrite layers and two dielectric layers in accordance with an illustrative embodiment.

FIG. 3 shows a top view of a multi-shell composite structure having two ferrite layers (104*a*, 104*b*) and two dielectric layers (106*a*, 106*b*) in accordance with an illustrative embodiment. In FIG. 3, the first dielectric layer 106*a* (having outer radius $r_{d1}$) surrounds a first ferrite layer 104*a* (having outer radius $r_{f1}$) by directly contacting the ferrite layer 104*a* to form an inner composite structure (104*a*, 106*a*), and the second dielectric layer 106*b* (having outer radius $r_{d2}$) directly surrounds a second ferrite layer 104*b* (having outer radius $r_{f2}$) by directly contacting the second ferrite layer 104*b* to form an outer composite structure (104*b*, 106*b*). The outer composite structure (104*b*, 106*b*) then surrounds the inner composite structure (104*a*, 106*a*) to form a solid structure.

Figure 4:
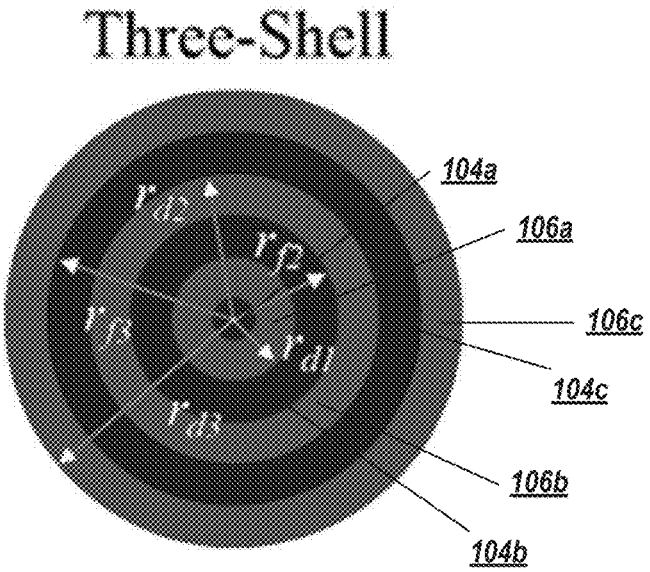
FIG. 4 shows a top view of a multi-shell composite structure having three ferrite layers and three dielectric layers in accordance with an illustrative embodiment.

FIG. 4 shows a top view of a multi-shell composite structure having three ferrite layers (104*a*, 104*b*, 104*c*) and three dielectric layers (106*a*, 106*b*, 106*c*) in accordance with an illustrative embodiment. In FIG. 4, the multi-shell composite structure (104*a*, 106*a*, 104*b*, 106*b*) includes the two composite structures (104*a*, 106*a* and 104*b*, 106*b*) of FIG. 3 and further includes a third composite structures (104*c*, 106*c*) that forms an outer compositive structure that surrounds the composite structure (104*a*, 106*b*), which now serves as an intermediate composite structure.

Indeed, N number of composite structures can be built and configured in this manner (e.g., having lossy or non-lossy ferrite material). For example, a composite structure having two sets of 4, 5, 6, 7, 8, 9, 10, 11, 12, 13, 14, 15, 16, 17, 18, 19, 20 number of layers of alternating dielectric layers and ferrite layers can be created. In some embodiments, multi-shell composite structure is configured with greater than 20 layers of dielectric layers and 20 layers of ferrite layers. In some embodiments, the number of dielectric layers to the number of ferrite layers are the same. In other embodiments, the number of dielectric layers to the number of ferrite layers are different.

The ferrite-dielectric composite structure 102 can be solid (e.g., as provided in FIGS. 2-4) as well as hollow.

Figure 5:
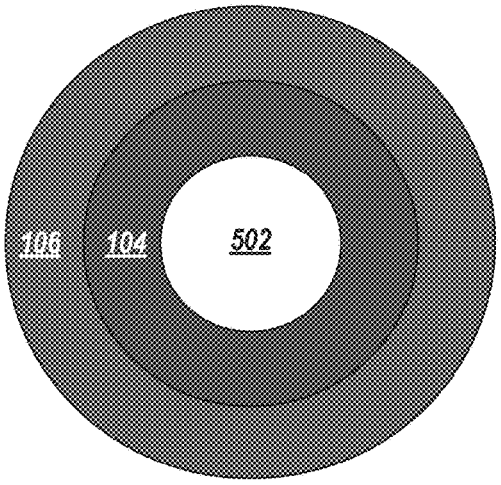
FIGS. 5-7 each shows a top view of either the single-shell composite structure or multi-shell composite structure of FIGS. 2-4 configured with a hollow center in accordance with an illustrative embodiment.
Figure 6:
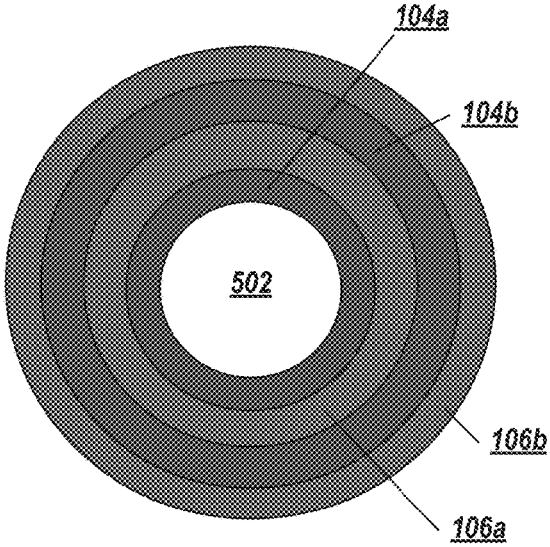
Figure 7:
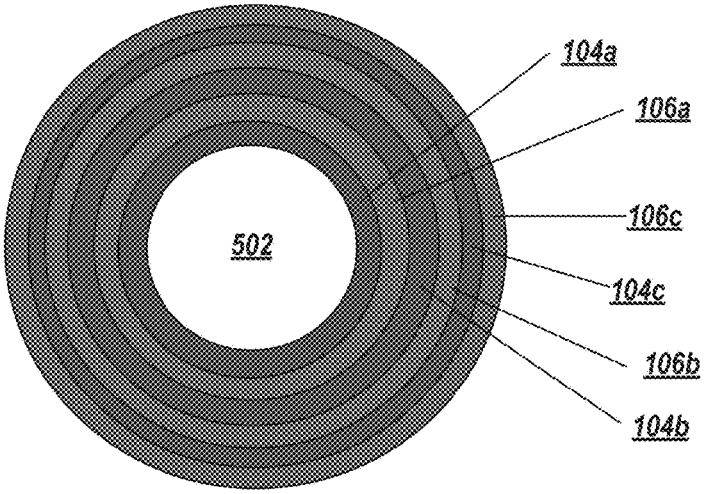

FIGS. 5-7 each shows a top view of either the single-shell composite structure or multi-shell composite structure of FIGS. 2-4 configured with a hollow center 502 in accordance with an illustrative embodiment. The hollow center 502 is defined by an air gap.

Specifically, FIG. 5 shows the single-shell composite structure (104, 106) of FIG. 2 configured with a hollow center 502. FIG. 6 shows a two-layer multi-shell composite structure (104*a*, 104*b*, 106*a*, 106*b*) configured with a hollow center 502. FIG. 7 shows a three-layer multi-shell composite structure (104*a*, 104*b*, 106*a*, 106*b*) configured with a hollow center 502.

Figure 8:
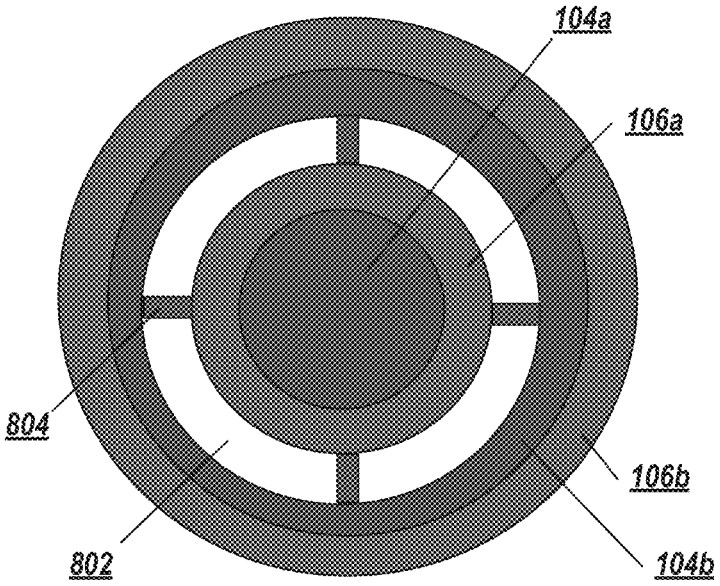
FIGS. 8 and 9 shows a two-layer multi-shell composite structure configured with an air gap located between each of an inner composite structure and an outer composite structure in accordance with an illustrative embodiment.
Figure 9:
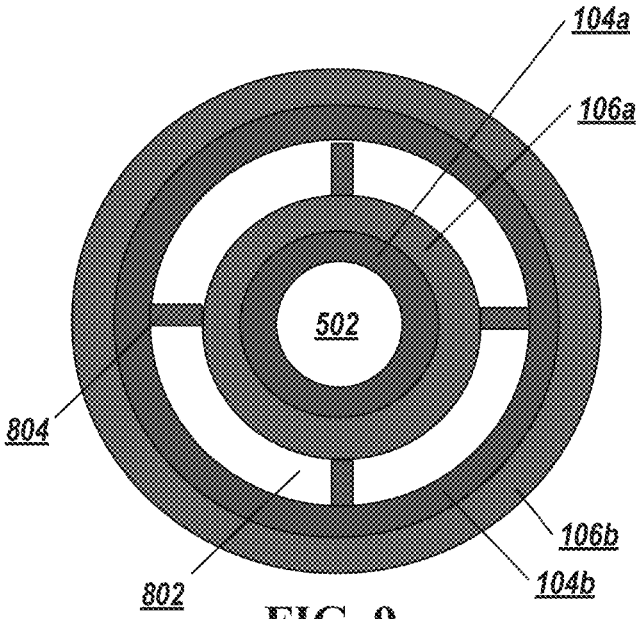

In addition to being hollow in the center region, the single-shell composite structure and multi-shell composite structure can be configured with an air gap. FIGS. 8 and 9 shows a two-layer multi-shell composite structure (104*a*, 104*b*, 106*a*, 106*b*) configured with an air gap 802 located between each of an inner composite structure (104*a*, 106*a*) and an outer composite structure (104*b*, 106*b*). The air gap 802 may include a support structure 804 to center the outer composite structure (104*b*, 106*b*) with respect to the inner composite structure (104*a*, 106*a*). FIG. 8 shows the two-layer multi-shell composite structure (104*a*, 104*b*, 106*a*, 106*b*) with a solid ferrite core in its center, and FIG. 9 shows the two-layer multi-shell composite structure (104*a*, 104*b*, 106*a*, 106*b*) with a hollow-center ferrite core (104*a*).

Though not shown in FIGS. 2-9, the conductor of the radiator 102 is wounded, in some embodiments, as a helix around the outer most layer of the composite structure. Two or more conductors of the radiator (not shown) can be used. In some embodiments, a monofilar helix is used. In some embodiments, a bifilar helix having 2 wires is used. In some embodiments, a quadrifilar helix having 4 wires is used. And as shown in FIGS. 1-9, the ferrite layers (104) and dielectric layers (106) generally have a uniform cross-sectional area.

Though shown cylindrical in shape, the single-shell composite structure and multi-shell composite structure can have other shapes in addition to a cylinder, such as a cone, an inverted cone, a sphere, a cuboid, a triangular prism, a pyramid, and a triangular-based pyramid, a hexagonal prism, a polygonal prism, and a polygonal pyramid.

In some embodiments, the ferrite core has a dielectric loss tangent (tan δεE) of at most 0.08 (e.g., equal to or less than 0.08).

Referring still to FIGS. 1-9, the helix-wounded radiator 102 and ferrite-dielectric composite structure, in some embodiments, is configured an axial-mode helical antenna (also referred to as a helical antenna). Axial-mode helical antenna generally has a wide bandwidth, can be easily constructed, has a real input impedance, and can produce circularly polarized fields. Axial-mode helical antenna, in some embodiments, has a diameter and pitch comparable to its operational wavelength. The axial-mode helical antenna may function as a directional antenna radiating a beam off the ends of the helix, along the antenna's axis.

Figure 10:
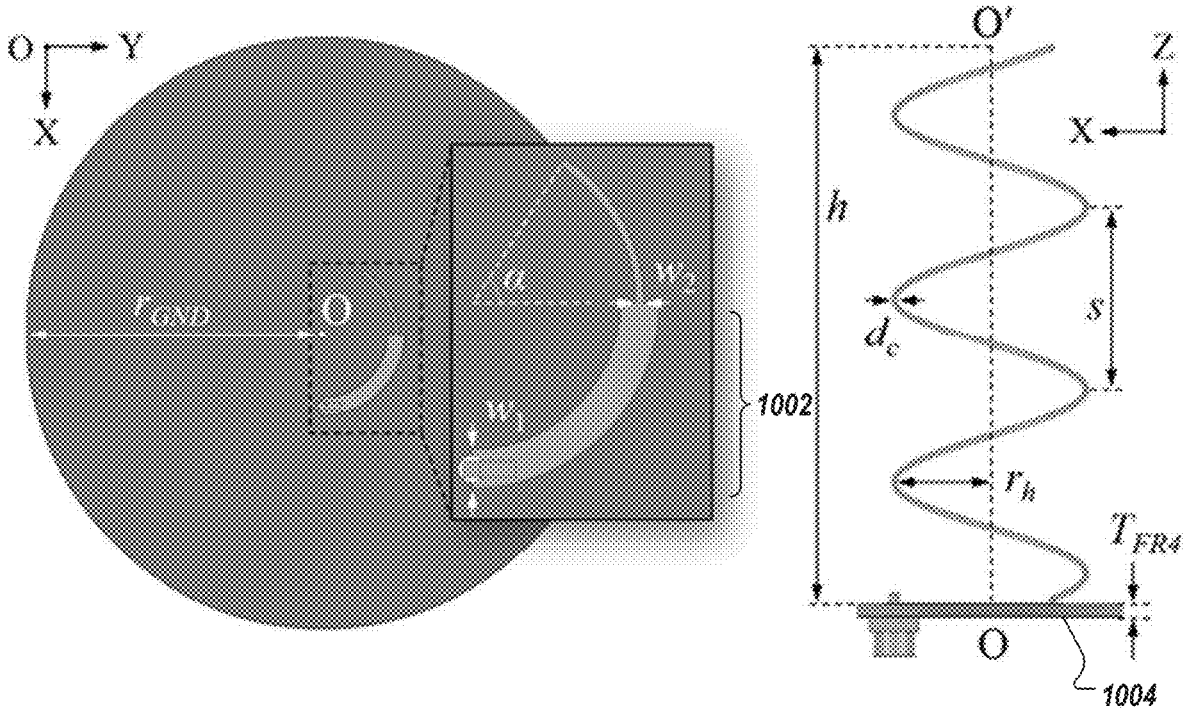
FIG. 10 is a diagram of a substrate configured with a quarter-wave transmission line 1002 in accordance with an illustrative embodiment.

In some embodiments, the substrate 108 is configured with a quarter-wave transmission line. FIG. 10 is a diagram of a substrate 108 configured with a quarter-wave transmission line 1002 in accordance with an illustrative embodiment. The substrate 108 may be used, e.g., in combination with any of the dielectric-ferrite composite structure of FIGS. 1-9. In FIG. 10, the quarter-wave transmission line (QTL) 1002 is configured with an impedance (e.g., to 50Ω) adjust the impedance of the antenna structure to match the input impedance of the antenna 100. A quarter-wave impedance transformer, often written as λ/4 impedance transformer, is a transmission line or waveguide of length one-quarter wavelength, terminated with a pre-defined impedance. The ground plane (not shown), in such embodiments, is located at a bottom surface 1004 of the substrate 108. The QTL further miniaturize a helical antenna (e.g., axial-mode helical antenna) and provides for a more integrated antenna (i.e., not having external impedance matching components).

In some embodiments, the QTL is printed on an FR4 epoxy substrate (e.g., having an $\varepsilon_r$=4.4, dielectric loss tangent (tan $\delta_\varepsilon$)=0.02. For a helical antenna with a diameter of 0.812 mm, the thickness of the QTL can be about 1.5 mm (e.g., ±5%). The radiator 102 can be directly or electrically coupled to the quarter-wave transmission line.

In some embodiments, the ferrite layer 104 (e.g., 104*a*, 104*b*, 104*c*, etc.) is made of material such as a spinel ferrite, a hexagonal ferrite, a ferrite composite, or a soft magnetic material having permeability higher than 1.

In some embodiments, the dielectric layer 106 (e.g., 106*a*, 106*b*, 106*c*, etc.) is made of material such as acrylonitrile butadiene styrene, polyactic acid, polyvinyl alcohol, glass, an organic material having permittivity higher than 1, an inorganic material having permittivity higher than 1, and a metallic material having permittivity higher than 1.

In some embodiments, the substrate 108 is made of material such as plastic (e.g. Bakelite), glass-reinforced epoxy laminate sheets (e.g. FR-4), glass-reinforced hydrocarbon/ceramic laminates (e.g. e.g., R04003), glass microfiber reinforced PTFE composite, and a glass having permeability higher than 1.

Figure 11:
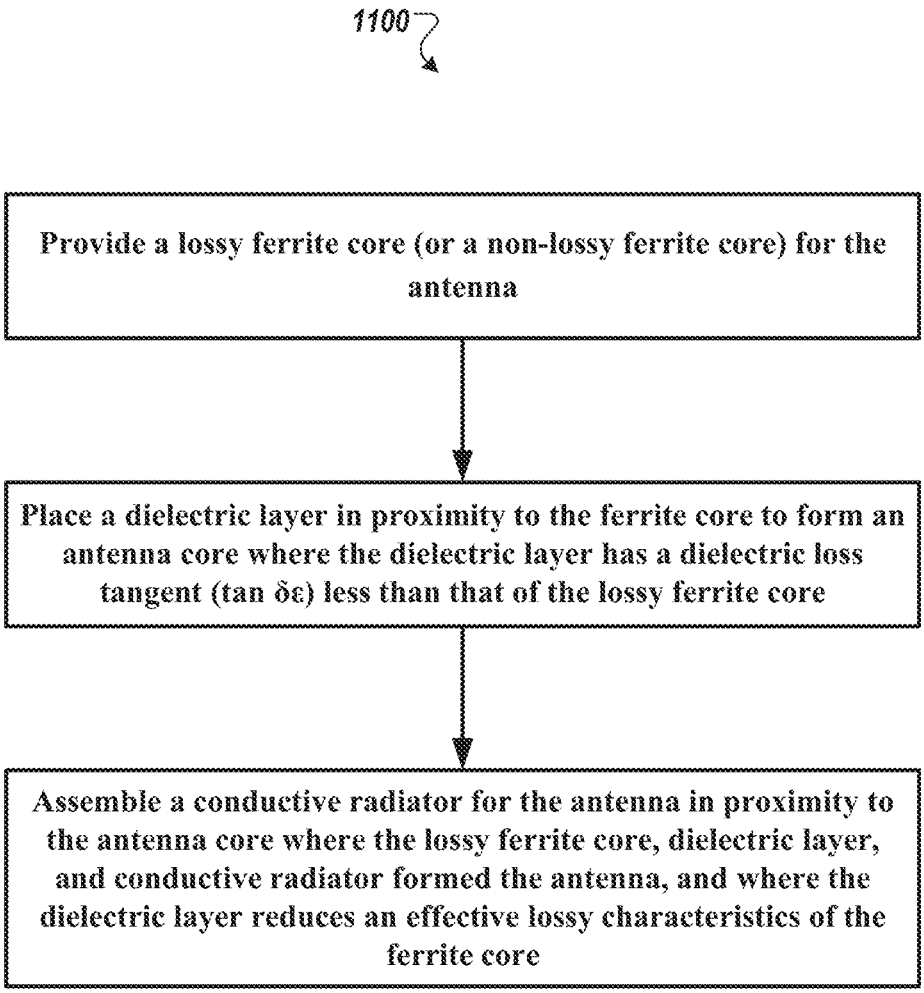
FIG. 11 is a diagram of a method of configuring an antenna, in accordance with an illustrative embodiment.

FIG. 11 is a diagram of a method 1100 of configuring an antenna, in accordance with an illustrative embodiment. In FIG. 11, the method 1100 includes providing (step 1102) a lossy ferrite core (or a non-lossy ferrite core) for the antenna. The method 1100 then includes placing (step 1104) a dielectric layer in proximity to the ferrite core to form an antenna core, wherein the dielectric layer has a dielectric loss tangent (tan $\delta_\varepsilon$) less than that of the lossy ferrite core. The method 1100 then includes assembling (1106) a conductive radiator for the antenna in proximity to the antenna core where the lossy ferrite core, dielectric layer, and conductive radiator formed the antenna, and where the dielectric layer reduces an effective lossy characteristics of the ferrite core.

Meandered Dipole Antenna

Figure 12:
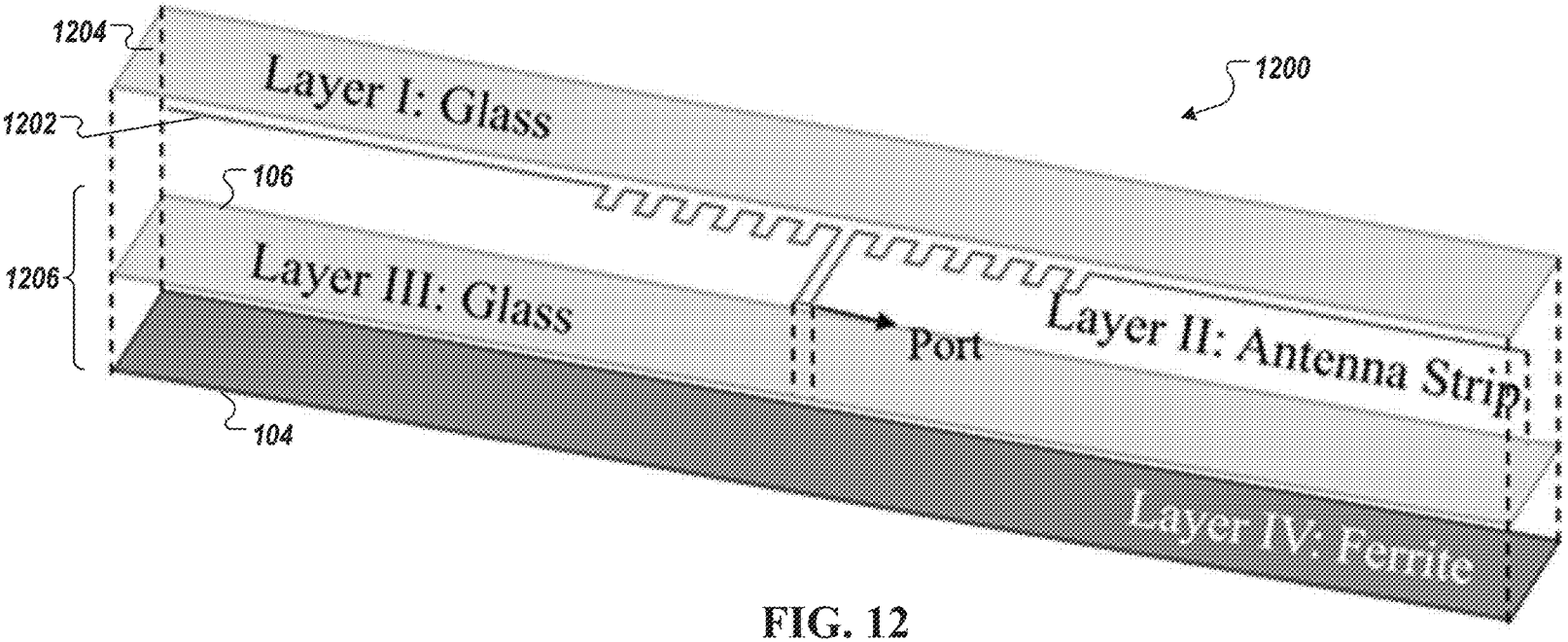
FIG. 12 is a diagram of a meandered dipole configured with a composite structure includes one or more ferrite layers and one or more dielectric layers in accordance with an illustrative embodiment.

In addition to helical antennas, the technique disclosed herein of coupling a dielectric layer to a ferrite layer to reduce the lossy characteristics of the ferrite layer can be applied to a meandered dipole antenna. FIG. 12 is a diagram of a meandered dipole antenna 1200 configured with a composite structure includes one or more ferrite layers 104 and one or more dielectric layers 106 in accordance with an illustrative embodiment. The meandered antenna 1200 can also be configured a monopole antenna or a multi-pole antenna (e.g., in a plane).

Figure 13:
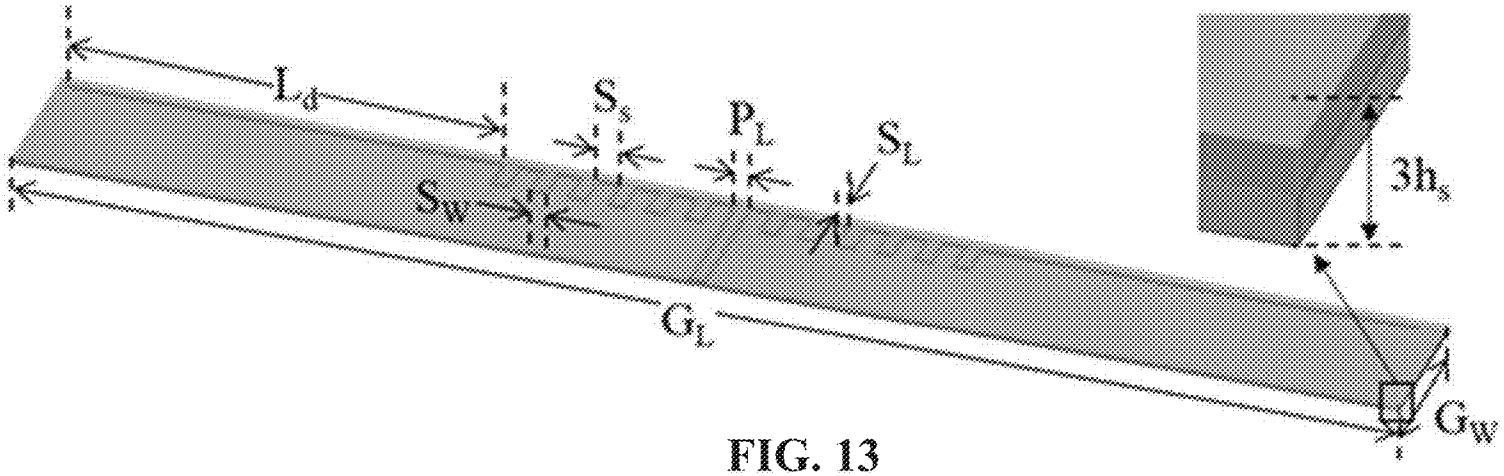
FIG. 13 shows the meandered dipole antenna of FIG. 12 in an assemble view in accordance with an illustrative embodiment.

In FIG. 12, the meandered dipole antenna 1200 includes a meandered radiator 1202 that is encapsulated by glass dielectric 1204 and a ferrite-dielectric composite structure 1204 in which the composite structure includes the ferrite layer(s) 104 and the dielectric layer(s) 106. As discussed in relation to FIGS. 1-9, the composite structure includes the ferrite layer(s) 104 and the dielectric layer(s) 106 is configured to reduce collective lossy characteristics of the one or more ferrite layer. FIG. 13 shows the meandered dipole antenna 1200 of FIG. 12 in an assemble view in accordance with an illustrative embodiment.

In some embodiments, the dielectric layer includes glass and the ferrite layer is made of a transparent ferrite material. The glass may be tempered or non-tempered. In such embodiment, the meandered dipole antenna is well suited for automotive applications as an on-glass antenna.

In some embodiments, the meandered dipole antenna 1200 is configured for RFID applications.

EXAMPLE #1

Figure 14:
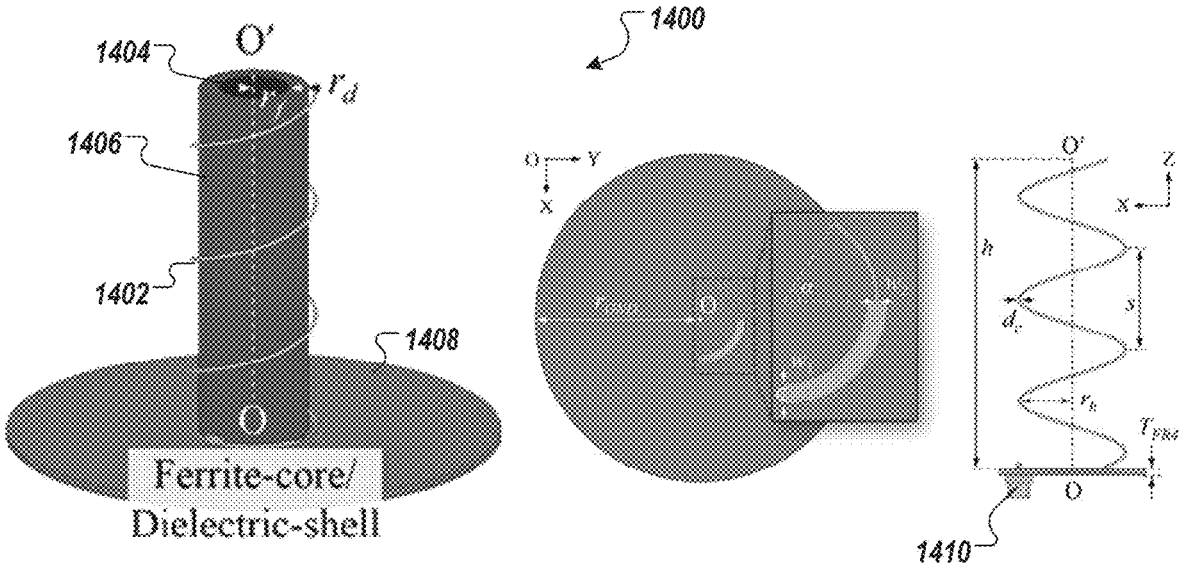
FIG. 14 show an example axial-mode helical antenna (e.g., any one of FIGS. 1-9) configured with lossy ferrite core (LFC-DS-AM-HA) in accordance with an illustrative embodiment.
Figure 14:
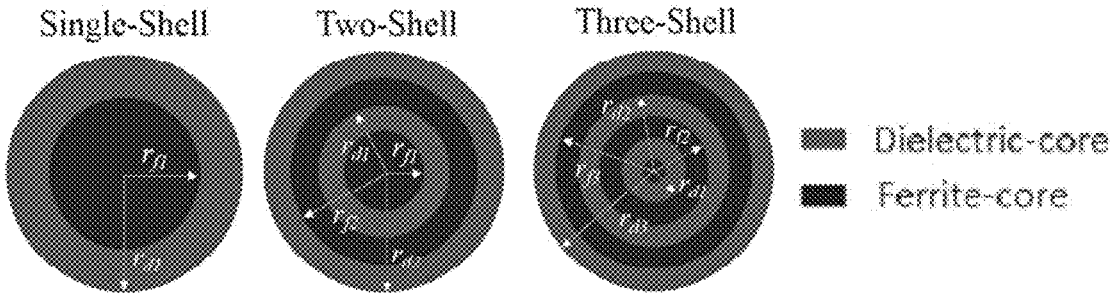

FIG. 14 shows an example axial-mode helical antenna (e.g., any one of FIGS. 1-9) configured with lossy ferrite core (LFC-DS-AM-HA) 1400 in accordance with an illustrative embodiment. The axial-mode helical antenna 1400 includes an inner $Co_2Z$-HGC core 1404 having $\mu_r$=2, tan $\delta\mu$=0.1, $\varepsilon_r$=7, and a dielectric loss tangent (tan $\delta\varepsilon$)=0.01. The axial-mode helical antenna 1400 includes an outer acrylonitrile butadiene styrene (ABS) shell 1406 having $\varepsilon_r$=2 and tan $\delta\varepsilon$=0.01 that surrounds the inner $Co_2Z$-HGC core 1404. The radius of the inner ferrite core ($r_f$) 1404 and outer dielectric shell ($r_d$) 1406 are 11 and 7 mm, respectively, in this example, though geometries and configuration can be used. FIG. 14 further shows example detailed dimensions of the LFC-DS-AM-HA.

In FIG. 14, the radiator 1402 is helically wound counterclockwise with 3 turns with a uniform conductor diameter ($d_c$) of 0.812 mm. The antenna 1400 includes a quarter-wave transmission line (QTL) (1410) printed on an FR4 epoxy substrate 1408 ($\varepsilon_r$=4.4, tan $\delta_\varepsilon$=0.02, thickness ($T_{FR4}$)=1.5 mm) to match the impedance (150Ω) of the antenna structure (1402, 1404, 1406) to the impedance of an input SMA connector (50Ω) 1410. The ground plane is located at the bottom of the substrate. This novel design offers a vast selection of ferrite for the volume reduction of AM-HA without sacrificing the antenna gain by overcoming the lossy characteristics of ferrite above 1 GHz.

Example #2

Figure 15:
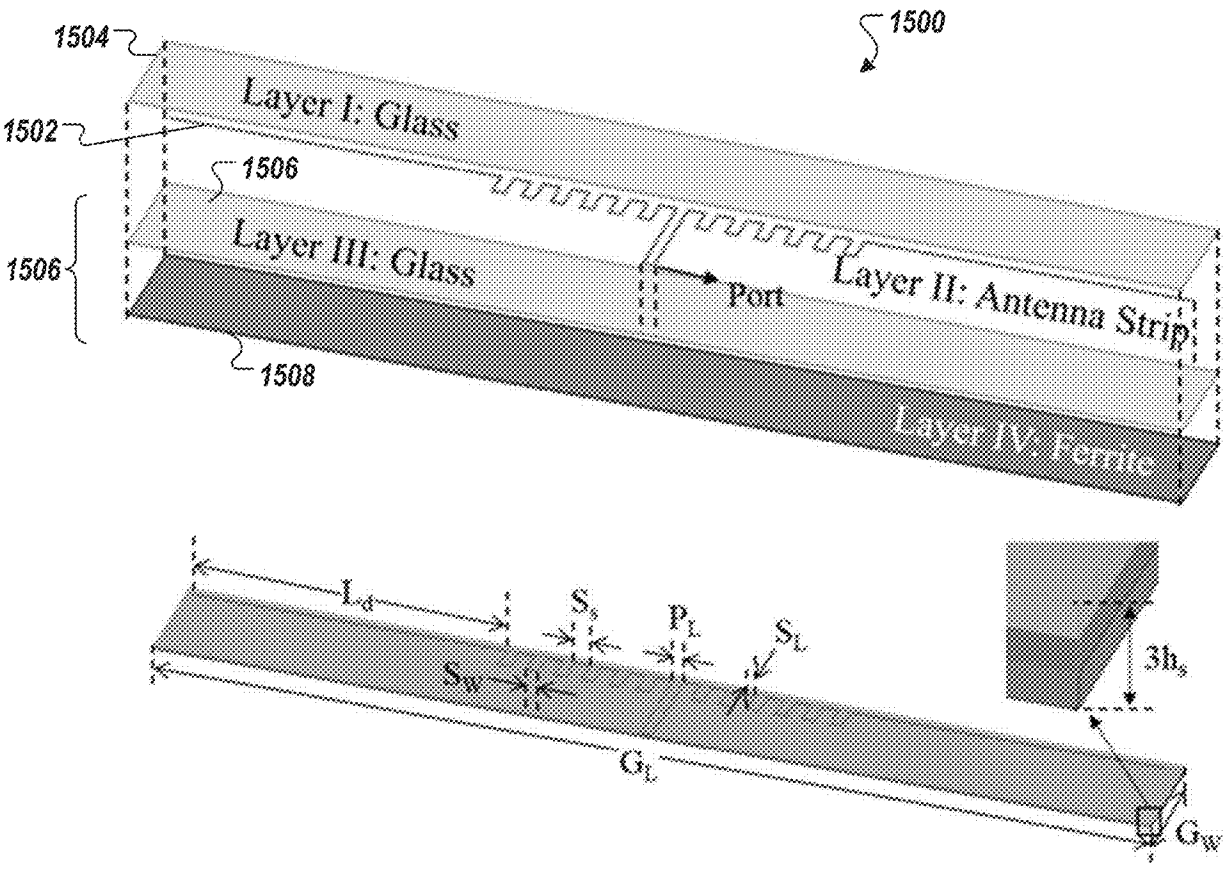
FIG. 15 show an example meandered dipole antenna (e.g., of FIGS. 12-13) configured with lossy ferrite core in accordance with an illustrative embodiment.

FIG. 15 show an example meandered dipole antenna 1500 (e.g., of FIGS. 12-13) configured with lossy ferrite core 1500 in accordance with an illustrative embodiment. In FIG. 15, the meandered dipole antenna 1500 is configured to optimally operate in frequency range of the FM radio (e.g., between about 88 MHz and about 108 MHz) (e.g., ±10%). In FIG. 15, the meandered dipole antenna 1500 includes, in some embodiments, at least 4 layers: Layer I (1504) comprising a glass substrate of thickness of 1.4 mm with $\mu_r$=1, tan $\delta_\mu$=0, $\varepsilon_r$=7, and tan $\delta_\varepsilon$=0.03; Layer II (1502) comprising a radiating copper strip having a dipole antenna configuration; Layer III (1506) comprising a glass substrate used in Layer I; Layer IV (1508) comprising a ferrite substrate of thickness of 1.4 mm with $\mu_r$=40, tan $\delta_\mu$=0.125, $\varepsilon_r$=7, and tan $\delta_\varepsilon$=0.01. The glass substrate layer 1506 and ferrite substrate layer 1508 are bonded to one another.

FIG. 15 shows example detailed dimensions of the meandered dipole antenna 1500. Indeed, the meandered dipole antenna 1500 has a reduced volume and an increased gain and bandwidth as compared to same antenna without the ferrite layer [18] [19].

In FIG. 15, the meandered dipole antenna 1500 is configured with a probe feedline 1510, through other feedline may be used.

Examples of other materials that can be used in meandered dipole antenna 1500 is provided in [18] and [19].

Experimental Results

Axial-Mode Helical Antenna

Several studies were conducted to evaluate the performance of the axial-mode helical antenna disclosed herein.

Figure 16:
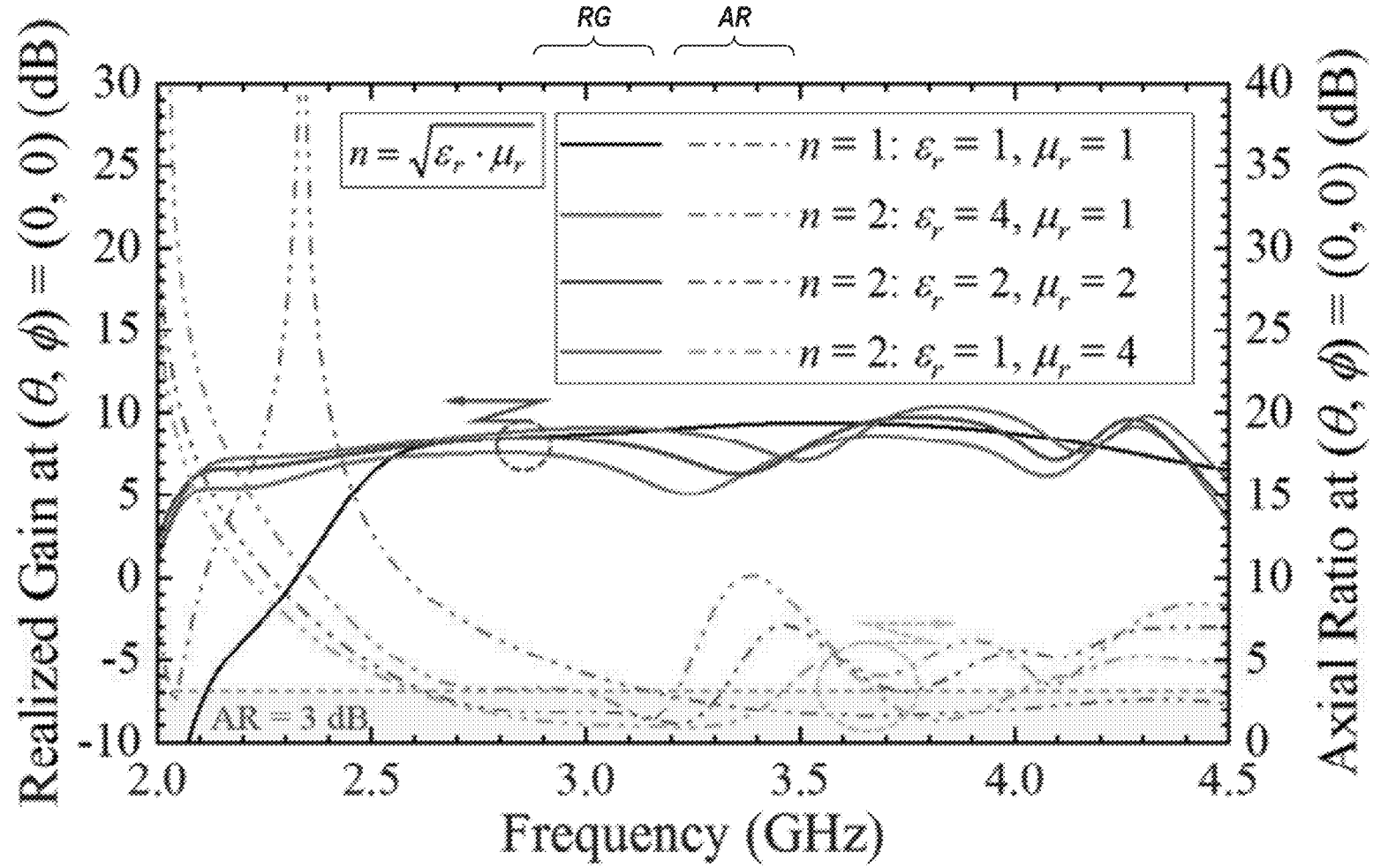
FIG. 16 shows quantitative results of effects of dynamic properties of a ferrite core on the performance of the axial-mode helical antenna in accordance with an illustrative embodiment.

FIG. 16 shows quantitative results of effects of dynamic properties, such as $\varepsilon_r$ and $\mu_r$, of having a ferrite core on the performance of the axial-mode helical antenna. The study simulated the instant axial-mode helical antenna(s) using ANSYS high-frequency structure simulator (HFSS v.18.1) for antenna performance. In the simulation, several arbitrary chosen values for $\varepsilon_r$ and $\mu_r$ of the core were evaluated: Core 1 having $\varepsilon_r$=1 and $\mu_r$=1 (n=1); Core 2 having $\varepsilon_r$=4 and $\mu_r$=1 (n=2); Core 3 having $\varepsilon_r$=2 and $\mu_r$=2 (n=2); and Core 4 having $\varepsilon_r$=1 and $\mu_r$=4 (n=2). In the simulation, the parameters tan $\delta_\varepsilon$, tan $\delta_\mu$, and the radius of the core were fixed to 0.01, 0.01, and 12 mm, respectively. Specifically, FIG. 16 shows the simulated frequency-dependent realized gain (RG) and the axial ratio (AR) at boresight ((θ, ϕ)=(0, 0)) of the axial-mode helical antenna for different core material properties (i.e., different $\varepsilon_r$ and $\mu_r$). In FIG. 16, the first crossing frequencies of the AR at boresight ($AR_{00}$) under 3 dB ($f_{AR00=}$3 dB) of the AM-HA with core 2, core 3, and core 4 are lower than the $f_{AR00=}$3 dB of the AM-HA with core 1, indicating the axial-mode helical antenna can be miniatured. In FIG. 16, the 3-dB AR bandwidth (BW) decreases as the $\varepsilon_r$ increases, and the AM-HA with the 4 core shows the widest 3-dB AR BW. Contrarily, the RG at the boresight ($RG_{00}$) increases as the $\mu_r$ of the core increases. All cored AM-HA show a good impedance matching (reflection coefficient (Γ)<−10 dB) from 2.5 to 4 GHz (not shown here). Accordingly, a ferrite-core (FC) loading can be more effective than a DC loading in AM-HA miniaturization, while exhibiting a good antenna performance.

Figure 17:
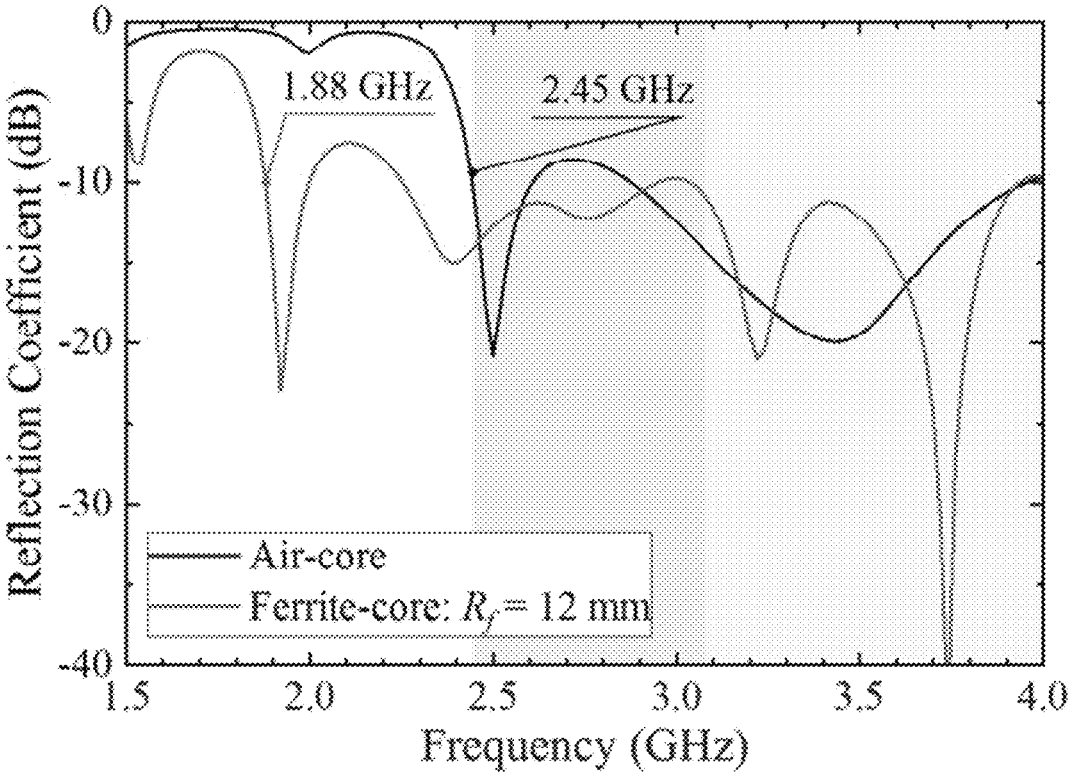
FIGS. 17 and 18 show more realistic simulations looking at a simulated frequency-dependent reflection coefficient F and radiation performance (e.g., $RG_{00}$ and $AR_{00}$) of a ferrite core axial-mode helical antenna (FC-AM-HA) in accordance with an illustrative embodiment.
Figure 18:
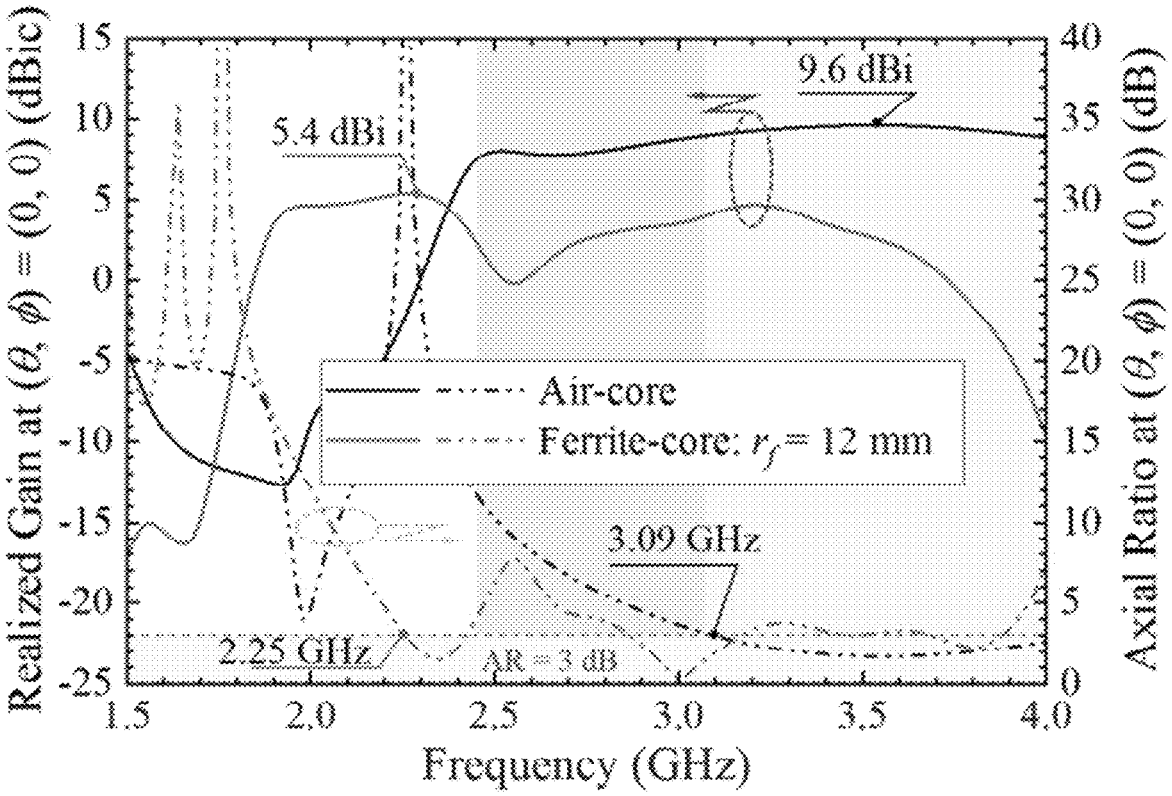

FIGS. 17 and 18 show more realistic simulations looking at a simulated frequency-dependent reflection coefficient F and radiation performance (e.g., $RG_{00}$ and $AR_{00}$) of a ferrite core axial-mode helical antenna (FC-AM-HA). An air-core axial-mode helical antenna (AC-AM-HA) was also simulated and shown in FIGS. 17 and 18 for a comparison. In the simulations, measured dynamic properties of a $Co_2Z$-HGC core (having $\mu_r$=2, tan $\delta_\mu$=0.1, $\varepsilon_r$=7, and tan $\delta_\varepsilon$=0.01), similar to those discussed in relation to FIG. 14, were evaluated. In the simulation, the helical radiator and feeding structure in FIG. 14 is also used with the radius of the ferrite core ($r_f$) set as 12 mm. As shown in FIG. 17, the loading of the ferrite core (FC) beneficially shifts the first crossing frequency of the 10-dB return loss to 1.88 from 2.45 GHz and $f_{AR00}$=3 dB to 2.25 from 3.09 GHz. However, as shown in FIG. 18, the loading also decreased the maximum $RG_{00}$ ($RG_{00_max}$) of the AC-AM-HA from 9.6 to 5.4 dBic, which is undesired.

Figure 19:
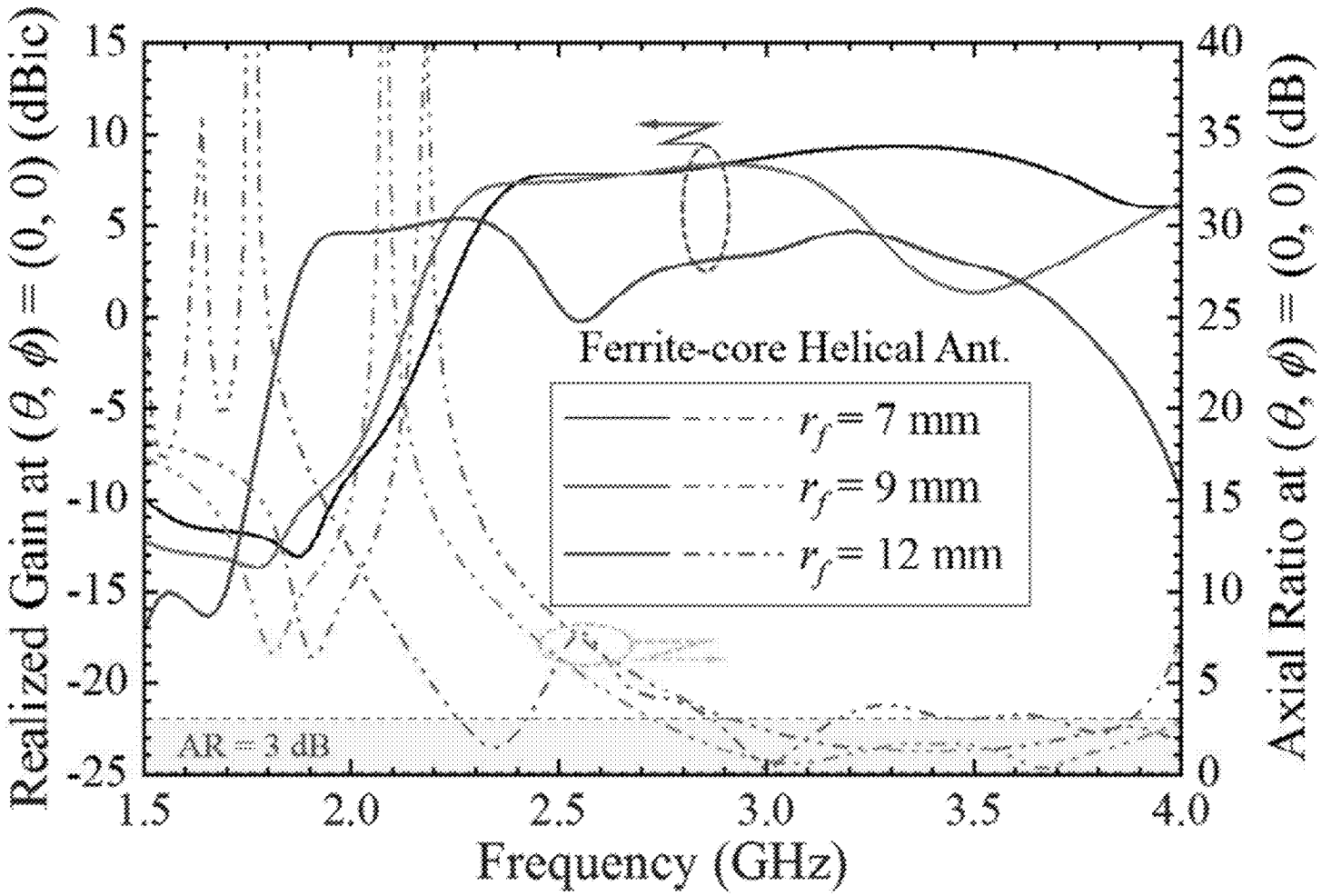
FIG. 19 shows results of parametric study to evaluate the effect of the size of the ferrite core $r_f$ on antenna performance in accordance with an illustrative embodiment.

FIG. 19 shows results of parametric study to evaluate the effect of the size of the ferrite core $r_f$ on antenna performance, including for $r_f$=7 mm, $r_f$=9 mm, and $r_f$=12 mm. As shown in FIG. 19, the realized gain $RG_{00_max}$ of the FC-AM-HA increased from 5.4 dBic to 9.4 dBic as the size of the ferrite core $r_f$ decreases from 12 mm to 7 mm. Further, a FC-AM-HA with a ferrite core size $r_f$ of 7 mm showed similar realized gain $RG_{00_max}$ to an AC-AM-HA of the same size, though the $f_{AR00=}$3 dB of FC-AM-HA shifted from 2.25 ($r_f$=12 mm) to 2.91 GHz ($r_f$=7 mm). By comparing results of the $f_{AR00=}$3 dB of an FC-AM-HA with the $f_{AR00=}$3 dB of an AC-AM-HA, the $f_{AR00=}$3 dB of FC-AM-HA ($r_f$=7 mm) is shown to have shifted to a lower frequency by only 180 MHz. This indicates that use of ferrite core by itself is insufficient to allow for antenna miniaturization. FIGS. 17-19 shows results of an axial-mode helical antenna configured with a ferrite core.

Figure 20:
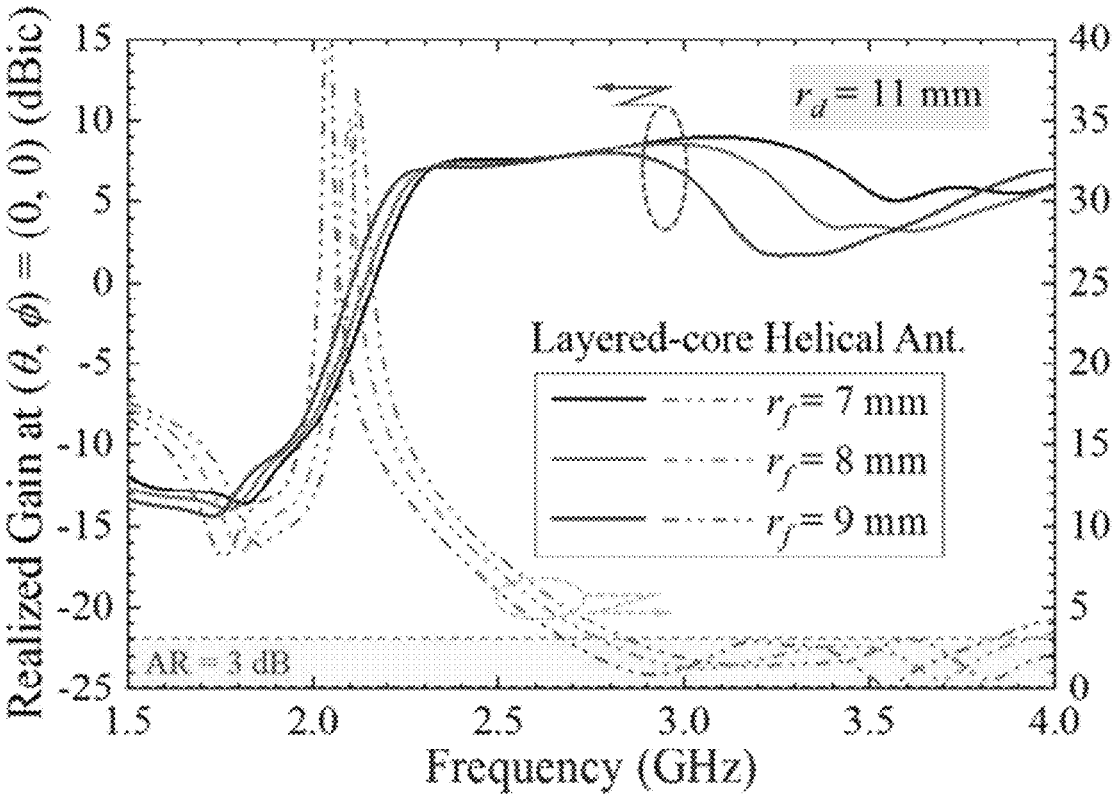
FIGS. 20-29 shows simulated performance of an axial-mode helical antenna configured with a lossy-ferrite-core and dielectric-shell (LFC-DS) AM-HA (e.g., as discussed in relation to FIGS. 1-9) in accordance with an illustrative embodiment.

FIGS. 20-29 shows performance of an axial-mode helical antenna configured with a lossy-ferrite-core and dielectric-shell (LFC-DS) AM-HA (e.g., as discussed in relation to FIGS. 1-9). FIGS. 20-279 illustrates that the axial-mode helical antenna of FIGS. 1-9 can be configured with minimal antenna gain loss. In FIGS. 20-27, an LFC-DS structure consisting of an inner $Co_2Z$-HGC core and outer acrylonitrile butadiene styrene (ABS) shell is evaluated. The LFC-DS structure comprising i) a $Co_2Z$-HGC core was simulated with measured $\mu_r$=2, tan $\delta_\mu$=0.1, $\varepsilon_r$=7, and tan $\delta_\varepsilon$=0.01 and ii) an ABS shell having ε'=2 and tan $\delta_\varepsilon$=0.01.

In FIG. 20, the $RG_{00}$ and $AR_{00}$ of LFC-DS-AM-HA (referred to in FIG. 20 as "Layered-core Helical Ant.") were evaluated via simulations for different inner ferrite core size $r_f$ where the outer radius of ABS-shell ($r_d$) is set to 11 mm. As shown in FIG. 20, as the ferrite core size $r_f$ increases from 7 mm to 9 mm, the $f_{AR00=}$3 dB decreases from 2.84 GHz to 2.68 GHz, while the $RG_{00_max}$ decreases from 9 to 8 dBic.

Figure 21:
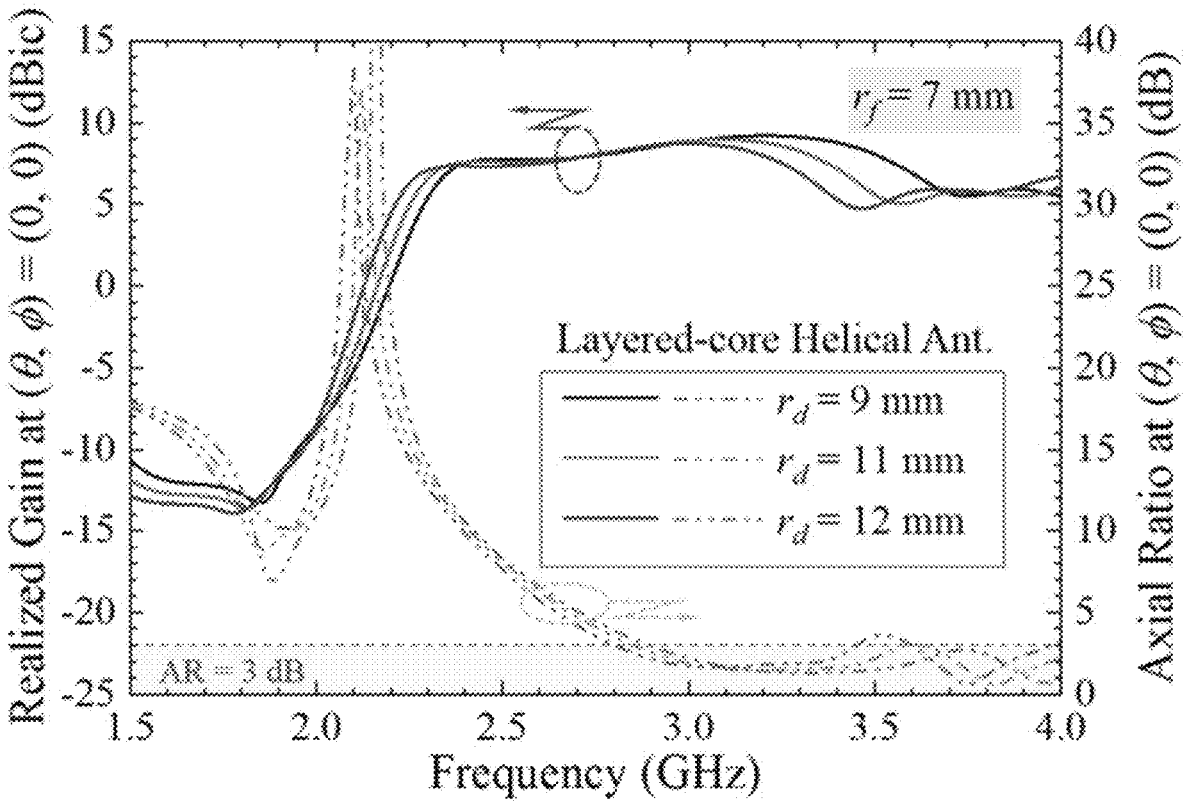

In FIG. 21, the $RG_{00}$ and $AR_{00}$ of LFC-DS-AM-HA with different outer radius of ABS-shell $r_d$ were evaluated via simulations where the $r_f$ is set to 7 mm. As shown in FIG. 21, as the outer radius of ABS-shell size increases from 9 mm to 12 mm, the $f_{AR00=}$3 dB decreased from 2.89 to 2.8 GHz, while the $RG_{00_max}$ decreases from 9.2 to 8.7 dBic. Indeed, the optimal value of the radius of the ABS shell $r_d$ for an LFC-DS-AM-HA was determined to be about 11 mm for a ferrite core having a radius $r_f$ of 7 mm.

Figure 22:
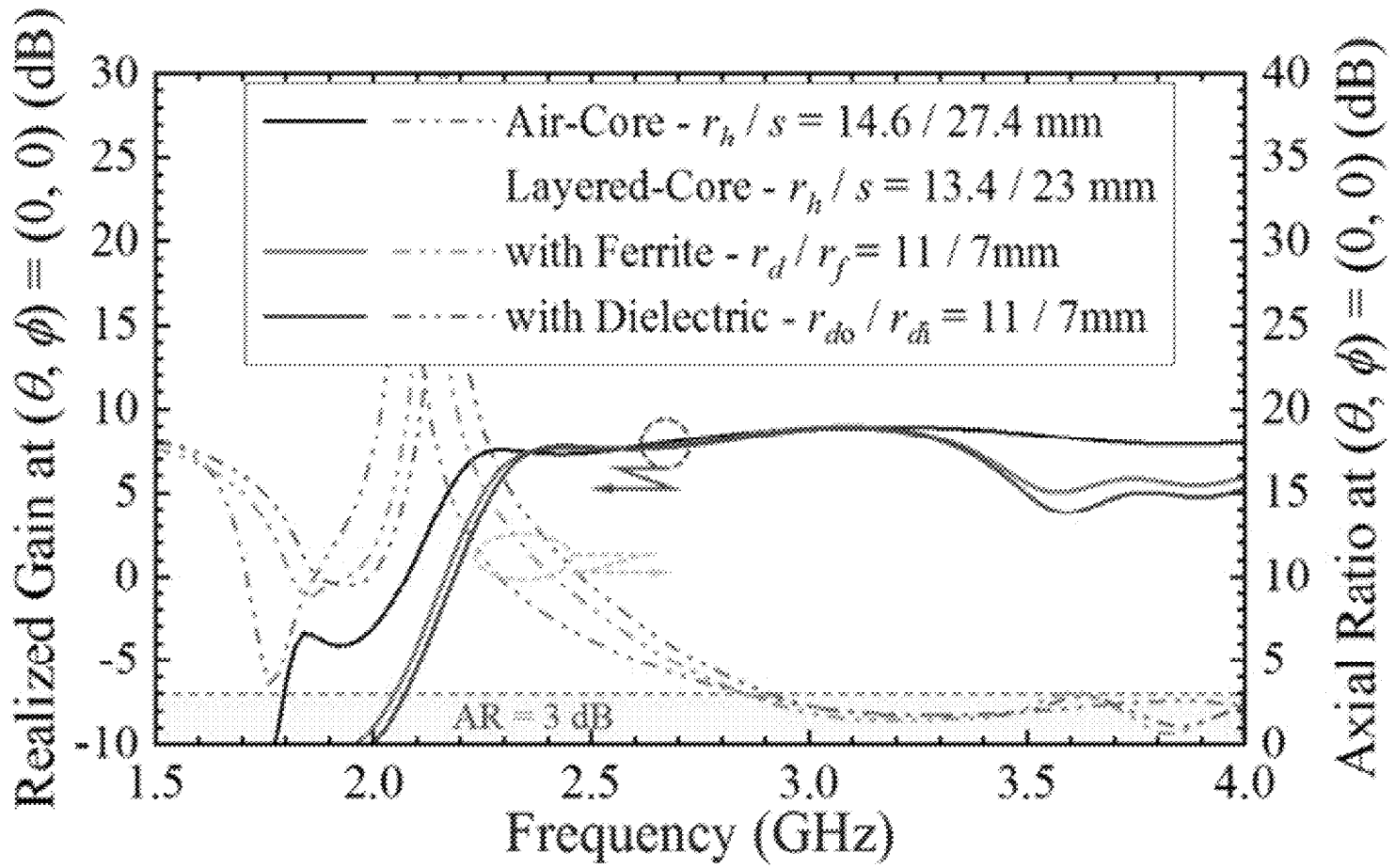

FIG. 22 shows quantification via simulations of $RG_{00}$ and $AR_{00}$ has antenna volume V is reduced by LFC-DS loading. In FIG. 22, simulated frequency-dependent $RG_{00}$ and $AR_{00}$ are shown for an air-core axial-mode helical antenna (having $r_h$=14.6 mm and s=27.4 mm); a first LFC-DS axial-mode helical antenna (having $r_h$=13.4 mm, s=23 mm) with ferrite inner-core ($r_f$=7 mm); a second LFC-DS axial-mode helical antenna (having $r_h$=13.4 mm, s=23 mm) with a dielectric outer-shell ($\varepsilon_r$=14).

As shown in FIG. 22, the air-core axial-mode helical antenna has a base-line volume of 55 $cm^3$ ($r_h$=14.6 mm and s=27.4 mm). For both the ferrite core antennas (layered and non-layered), the $f_{AR00=}$3 dB appears at about 2.84 GHz, and the $RG_{00_max}$ is 9 dBic. Indeed, the volume V of the ferrite core AM-HA is reduced by about 29% (from 55 $cm^3$ to 38.9 $cm^3$) by loading with a lossy ferrite core LFC-DS having a radius $r_d$ of 11 mm and $r_f$ of 7 mm. Further a volume V reduction of 43% is achievable by loading the LFC-DS with $r_d$ and $r_f$ of 12 and 7 mm, respectively where the configuration has a slight decrease in $RG_{00_max}$ of 0.3 dBic (not shown).

To compare the dielectric loading effectiveness in the V reduction with the ferrite loading, the inner lossy FC (LFC) of LFC-DS-AM-HA was replaced with a dielectric-core (DC) with $\varepsilon_r$ of 14. The simulation results show that a dielectric-core loaded AM-HA (DC-AM-HA) showed 0.07 GHz higher $f_{AR00=3dB\ and}$ 0.1 dBic lower $RG_{00_max}$ than those of the LFC-DS-AM-HA. Although the LFC-DS-AM-HA produced a high $RG_{00}$ of 9 dBic up to 3.2 GHz, the gain decreased to 5.2 dBic as the frequency increases.

Figure 23:
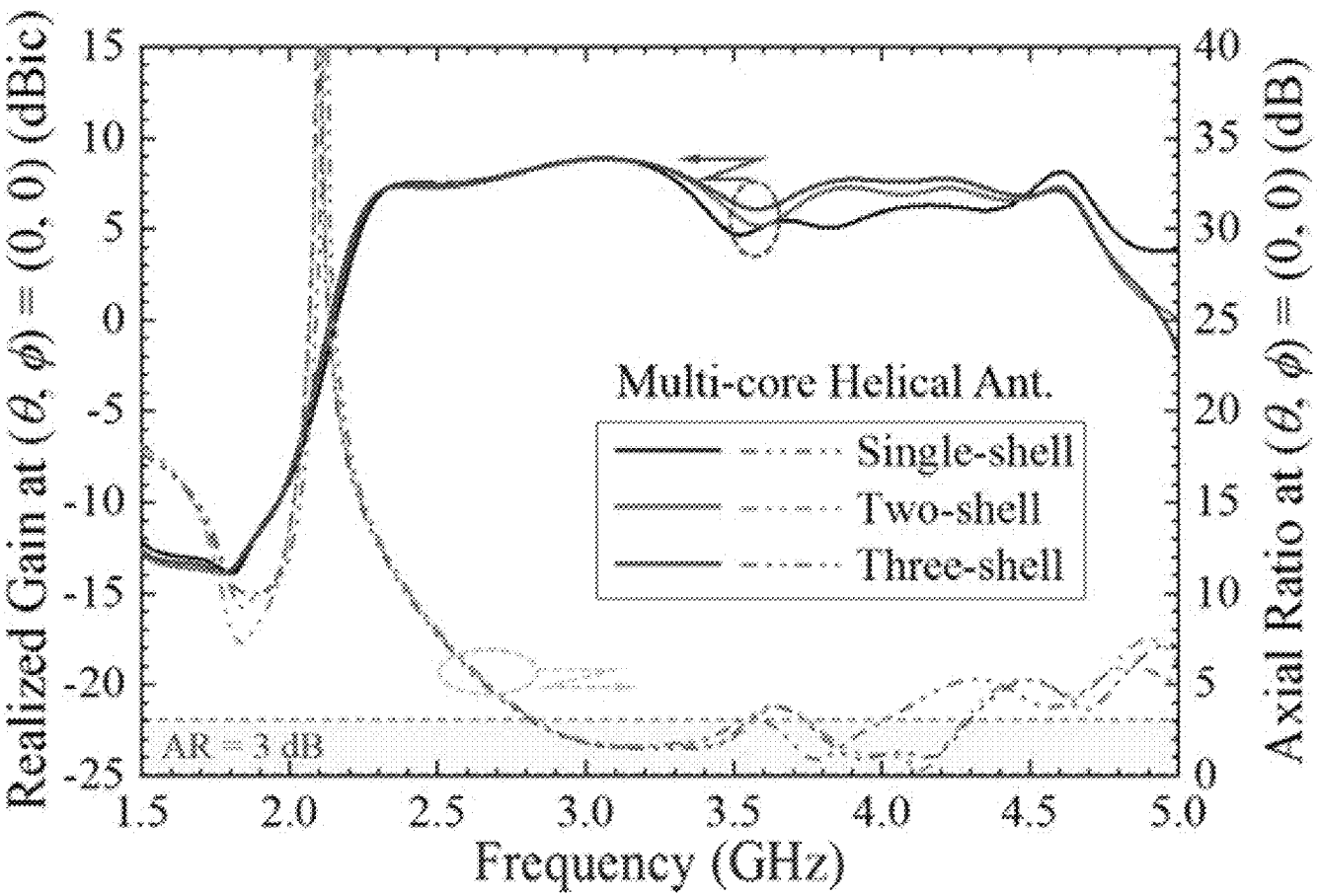

To compensate for the gain degradation, a multi-shell LFC-DS-AM-HA can be used. FIG. 23 shows quantification via simulations of $RG_{00}$ and $AR_{00}$ for a single shell axial-mode helical antenna and for two multi-shell axial-mode helical antennas. For the comparison, the same volumes of ferrite-core and dielectric-shell and helical radiator structure were used between single-shell and multi-shell LFC-DS-AM-HA.

Table 1 shows dimensions for single shell axial-mode helical antenna and for two multi-shell axial-mode helical antennas, e.g., shown in FIG. 14, used in the analysis.

TABLE 1

| Structure | $r_{f1}$ | $r_{f2}$ | $r_{f3}$ | $r_{d1}$ | $r_{d2}$ | $r_{d3}$ |
|---|---|---|---|---|---|---|
| Single | 7 mm | — | — | 11 mm | — | — |
| Two | 3.605 mm | 8.535 mm | — | 6.07 mm | 11 mm | — |
| Three | 1 mm | 5 mm | 9 mm | 3 mm | 7 mm | 11 mm |

Referring still to FIG. 23, the simulated frequency-dependent $RG_{oo}$ and $AR_{oo}$ of an LFC-DS-AM-HA with a single-shell structure, a two-shell structure, and a three-shell structure is provided. Table II shows the antenna performance of the LFC-DS-AM-HA for the three different shell structures.

TABLE 2

| Structure | $f_{AR00-3dB}$ [GHz] | 3-dB AR BW [MHz] | $RG_{00}$ at 3.84 GHz [dBic] |
|---|---|---|---|
| Single | 2.84 | 730 | 5.1 |
| Two | 2.83 | 1,450 | 7.1 |
| Three | 2.81 | 1,490 | 7.7 |

As shown in FIG. 23, a two-shell LFC-DS-AM-HA and a three-shell LFC-DS-AM-HA exhibit 2.1 dBic and 2.6 dBic, respectively, higher realized gain $RG_{00}$ at 3.84 GHz (as compared to the single-shell configuration) and exhibit 720 MHz and 760 MHz, respectively, wider $AR_{00}$ (as also compared to the single-shell configuration). From these results, the study concluded that an LFC-DS structure with an inner lossy ferrite core (LFC) can help to miniaturize by decreasing the volume V of an axial-mode helical antenna (AM-HA) at the expense of realized gain (RF) even for a ferrite material having a high tan $\delta_\mu$ of 0.1 while obtaining a broader 3-dB-AR-BW than a dielectric core (DC) with high $\varepsilon_r$.

To verify the simulated effectiveness of the lossy ferrite core (LFC) loading in an AC-DS-AM-HA and LFC-DS-AM-HA, miniatured physical devices were fabricated according to the parameters used in the parametric study.

Figure 24:
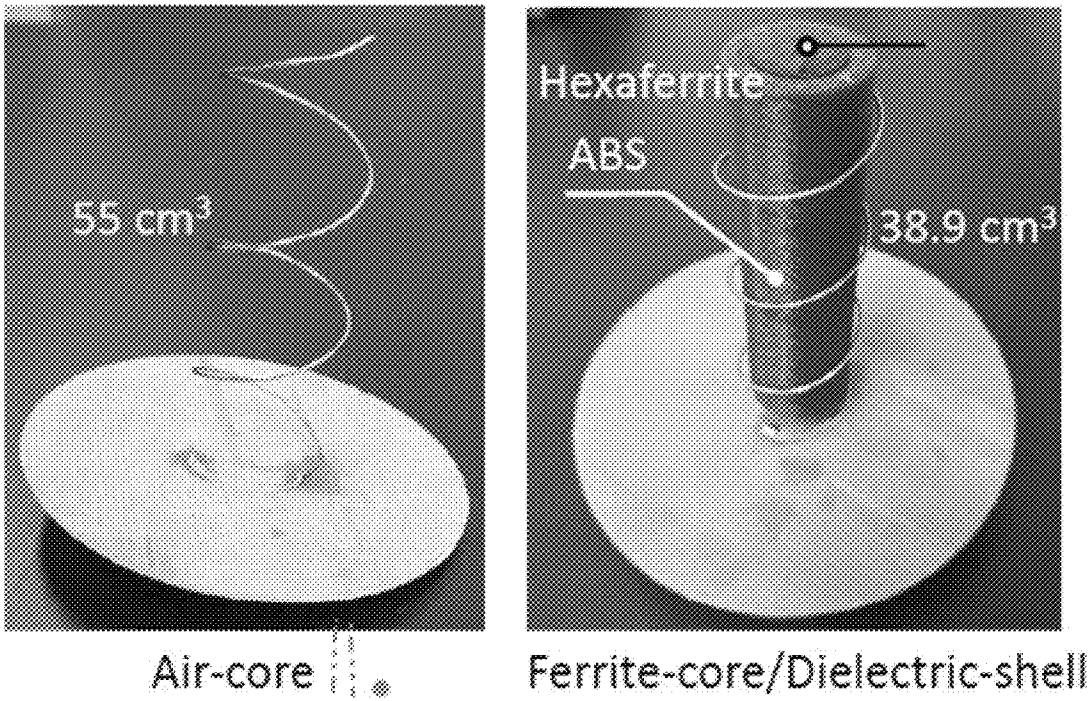

FIG. 24 is a photograph of a fabricated AC-DS-AM-HA and LFC-DS-AM-HA. In FIG. 24, the AC-DS-AM-HA and LFC-DS-AM-HA are each constructed with a 20 AWG copper wire (diameter=0.812 mm) which is helically wounded in counterclockwise with 3 turns. A quarter-wave transmission line (QTL) is formed on a double-sided copper-clad laminate FR-4 epoxy substrate using a precision milling machines (LPKF ProtoMat S62). Then, a 50-Ω SMA connector was connected to the feedline of the antennas.

To fabricate the inner lossy ferrite core, $Co_2Z$-HGC powder was prepared with the synthetic process [20] for the inner LFC. The powder was then pressed into a cylinder having a radius of 7 mm and sintered. To fabricate the dielectric outer-shell, a hollow cylinder with outer- and inner-radius of 11 and 7 mm, respectively, was printed with a 3D-printer (HICTOP 3DP-12) and ABS filament. The filament was extruded and deposited onto a test platform where the platform and nozzle were heated up to 110° C. and 240° C., respectively. Then, the printed ABS-shell was cooled at room temperature (e.g., about 19° F. to 22° F.) for about 10 minutes. After cooling, the lossy ferrite core (LFC) was inserted into the hollow structured ABS-shell. The fabricated antenna was characterized with a vector network analyzer (VNA: Agilent N5230) for scattering parameters and an in-lab anechoic chamber (Raymond EMC QuietBox AVS 700) with a linearly dual-polarized horn antenna for antenna radiation pattern. The AR of the fabricated antennas were calculated from the measured data [21].

Figure 25:
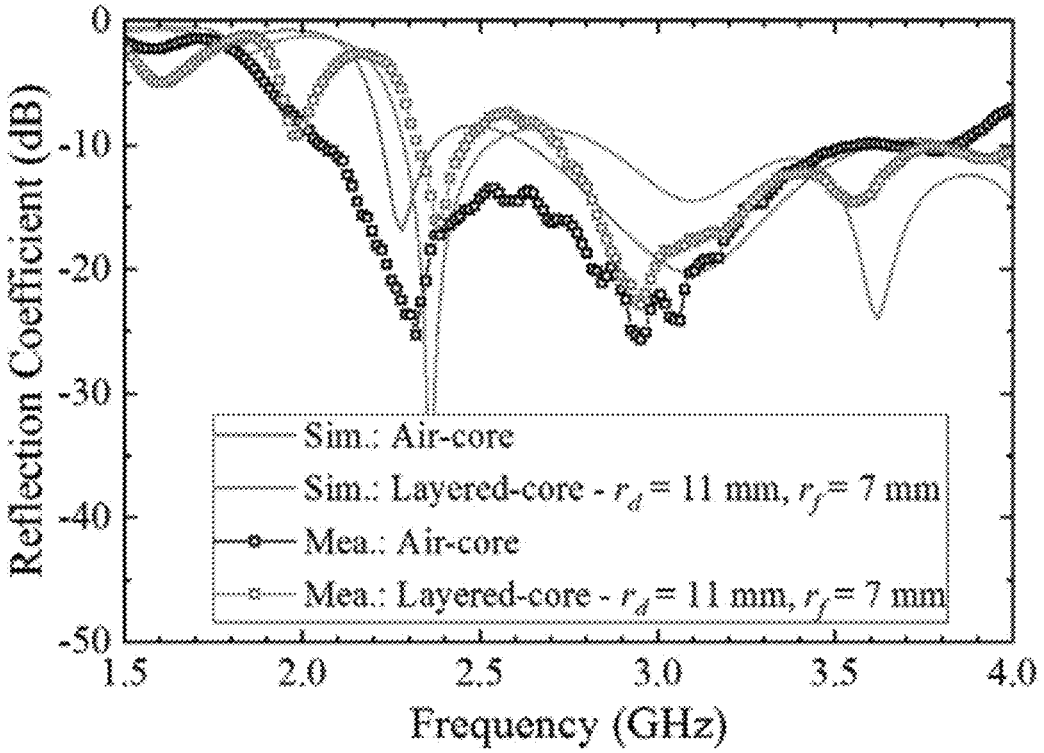
Figure 26:
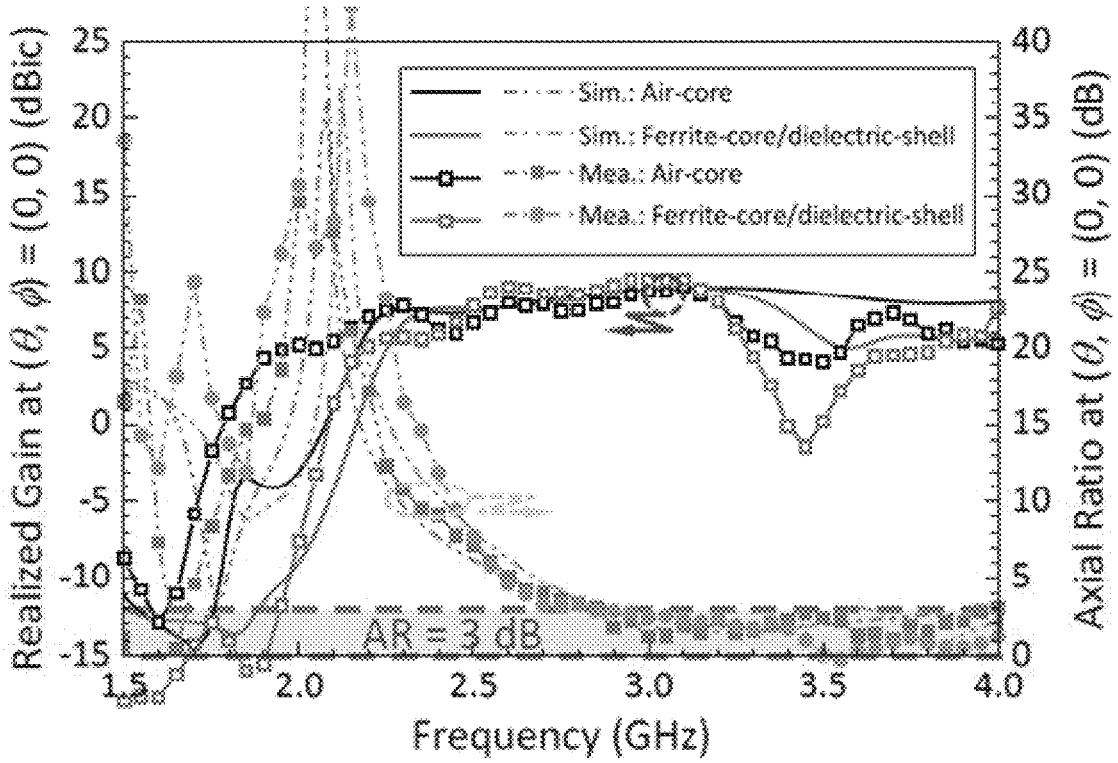

FIGS. 25 and 26 show measured and simulated frequency-dependent reflection coefficient F and radiation performance (e.g., $RG_{00}$ and $AR_{00}$) for a fabricated and simulated AC-AM-HA and LFC-DS-AM-HA of FIG. 24. FIGS. 25 and 26 show reasonable agreement between the measured and simulated results.

In FIG. 26, the $f_{AR00=}$3 dB of AC-DS-AM-HA and LFC-DS-AM-HA is around 2.84 GHz. In FIG. 26, as for 3-dB AR BW, a reasonably good impedance matching was observed from both fabricated AC-DS-AM-HA and LFC-DS-AM-HA. Also shown in FIG. 26, measured $RG_{00_max}$ of the fabricated LFC-DS-AM-HA within the 3-dB AR BW were 9.5 dBic, which is 0.5 dBic higher than the measured $RG_{00_max}$ of AC-AM-HA. The measured results confirms the simulation results that the antenna can be miniaturized by loading antenna with the LFC-DS structure without causing realized degradation.

Figure 28:
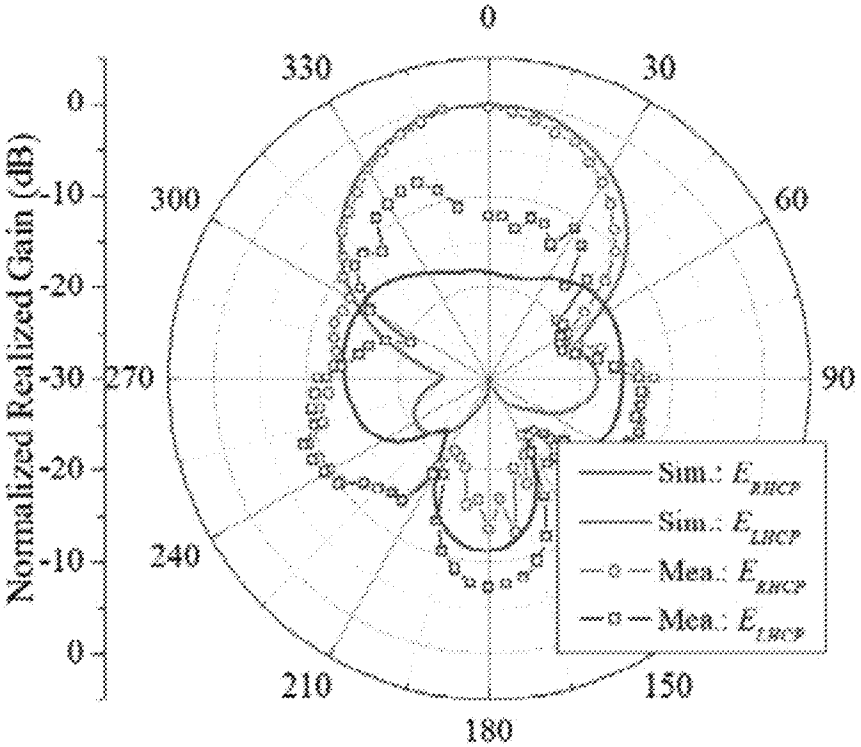
Figure 27:
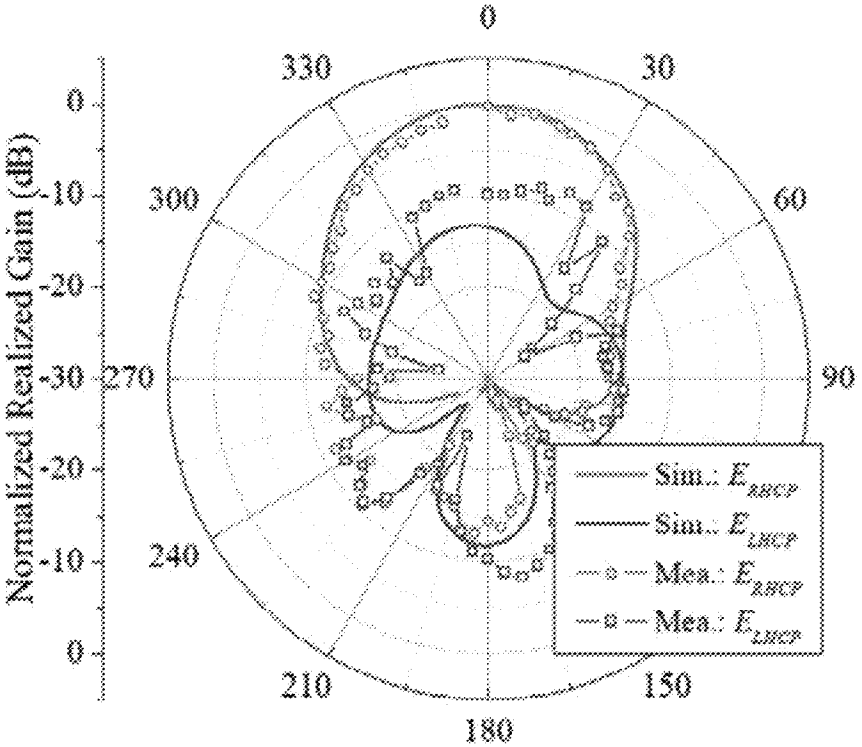

FIGS. 27 and 28 show the measured and simulated far-field normalized radiation patterns (NRP) at 2.9 GHz for an AC-AM-HA and LFC-DS-AM-HA. In FIGS. 27 and 28, the measured NRP of the fabricated devices are well in agreement with the simulated NRP.

In FIGS. 27 and 28, both fabricated antennas are observed to have the directional radiation pattern along the axis of the helical radiator. In FIGS. 27 and 28, both antennas are observed to have cross-polarization level of nearly −10 dB at boresight. Table 3 shows antenna performance and volume V of the results shown in FIGS. 27 and 28.

Figure 29:
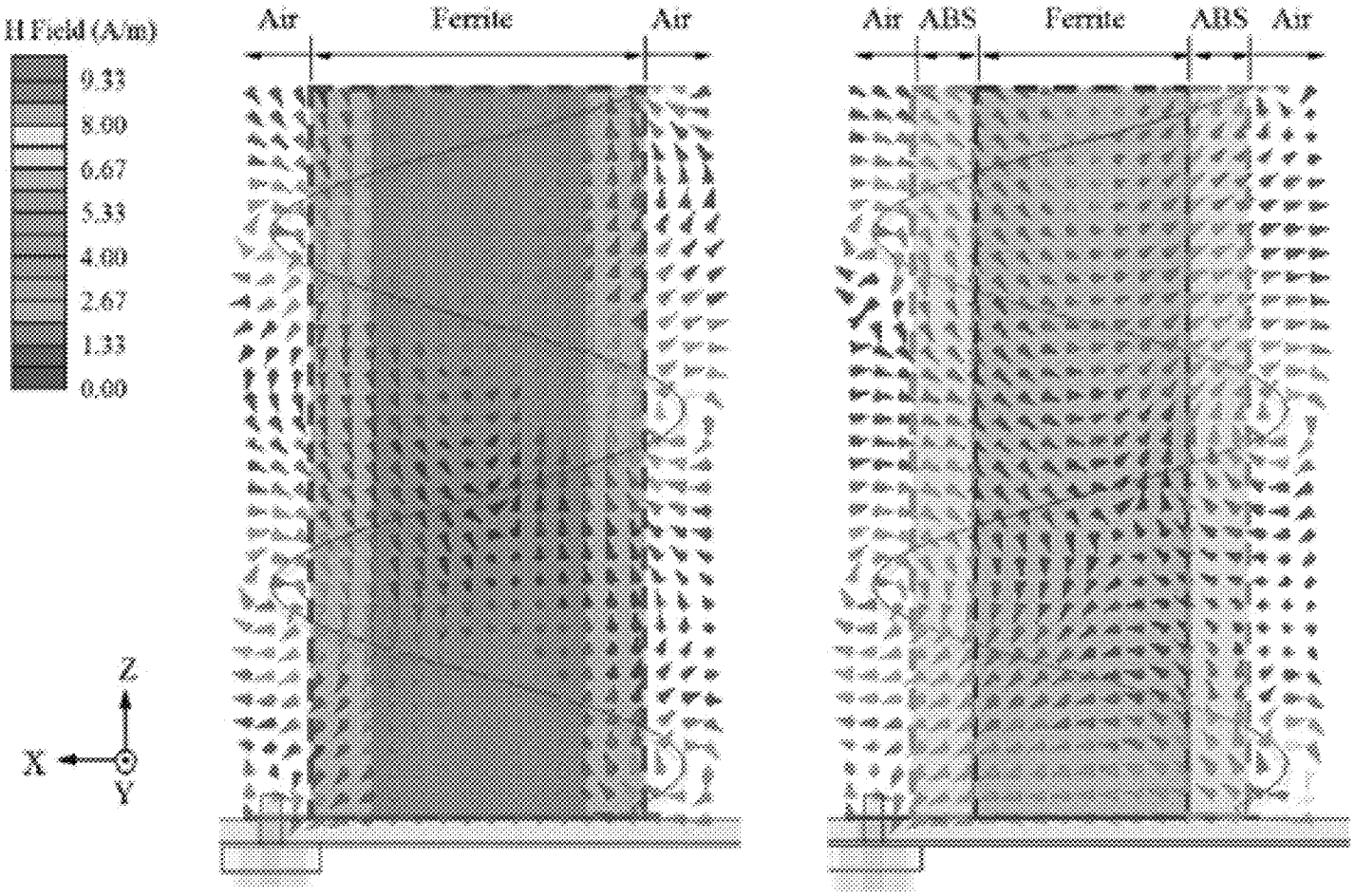

To further explain the origin of high $RG_{00}$ by loading the LFC in contrast with the FC loading, a vector magnetic field distribution of a FC-DS-AM-HA (left) and LFC-DS-AM-HA (right) are presented in FIG. 29. As shown in FIG. 29, the magnetic flux in the light brown region (Ferrite region) for FC-AM-HA (left) are less rotated as compared to magnetic flux in the light green region (ABS-shell region) for LFC-AM-HA (right). Indeed, the magnetic flux in the FC lags behind the magnetic field generated by the alternating current on the helical coil. This lagging may be attributed to the energy loss due to the magnetic loss of the FC [13]. Indeed, the ABS-shell appears to mitigate $RG_{00}$ degradation near the region where the magnetic fields changes dramatically with high magnitude. That is, the LFC-DS-AM-HA is less vulnerable to the magnetic loss of the ferrite and thus outperforms the FC-DS-AM-HA.

Meandered Dipole Antenna

A study was conducted to evaluate the performance of the meandered dipole antenna disclosed herein. The performance of a layered glass-ferrite integrated meandered dipole antenna of FIG. 15 was compared with that of a glass-integrated meandered dipole antenna without the ferrite layer (Layer IV). Table 4 shows a summary of the configuration of the glass-integrated meandered dipole antenna and its performance.

TABLE 4

| Parameter | Without ferrite layer | With ferrite layer |
|---|---|---|
| Area [$cm^2$] | 2749.7 | 1398.5 |
| Area Reduction [%] | — | 49.1 |
| Maximum Realized Gain [dBi] | −1.67 | −1.01 |
| −3 dB Bandwidth [MHz] | 9.8 | 15.5 |

As shown in Table 4, as compared to the antenna without the ferrite layer, the glass-ferrite integrated meandered dipole antenna has a volume reduction of 49.1% and a realized gain and bandwidth increase of 39.5 and 58.2%, respectively.

Figure 30:
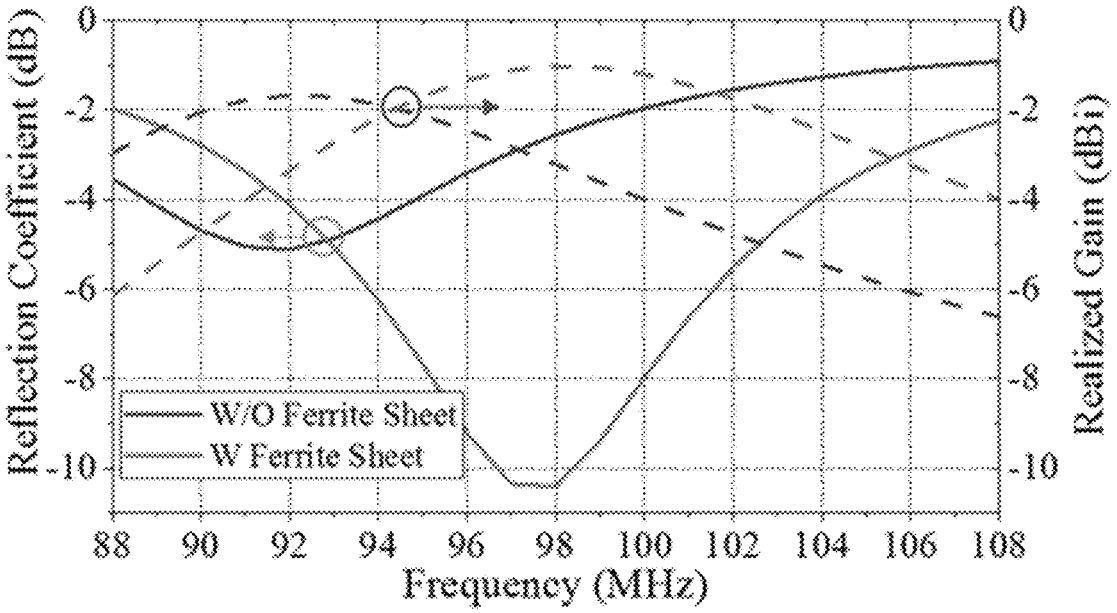
FIG. 30 shows radiation performance of the layered glass-ferrite integrated meandered dipole antenna of FIG. 15 in accordance with an illustrative embodiment.

FIG. 30 shows radiation performance of the layered glass-ferrite integrated meandered dipole antenna of FIG. 15 in accordance with an illustrative embodiment. As shown in FIG. 30, both meandered antennas (with ferrite sheet and without ferrite sheet) resonating in the FM frequency range (e.g., between 88 and 108 MHz). Indeed, the LFC-DS technique (e.g., as implemented in FIGS. 1-11) are applicable to the other antenna type such as meandered antennas.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including matters of logic with respect to arrangement of steps or operational flow;

plain meaning derived from grammatical organization or punctuation; the number or type of embodiments described in the specification.

Throughout this application, various publications may be referenced. The disclosures of these publications in their entireties are hereby incorporated by reference into this application in order to more fully describe the state of the art to which the methods and systems pertain.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

The following patents, applications and publications as listed below and throughout this document are hereby incorporated by reference in their entirety herein.

[1] L. Liu, Y. Li, Z. Zhang, Z. Feng, "Circularly Polarized Patch-Helix Hybrid Antenna With Small Ground," IEEE Antennas Wireless Propag. Lett., vol. 13, pp. 361-364, 2014.

[2] N. Neveu, Y.-K. Hong, J. Lee, J. Park, G. S. Abo, W. Lee, and D. Gillespie, "Miniature Hexaferrite Axial-Mode Helical Antenna for Unmanned Aerial Vehicle Applications," IEEE Trans. Magn., vol. 49, p. 4265, 2013.

[3] H. Nakano, H. Takeda, T. Honma, H. Mimaki, and J. Yamauchi, "Extremely Low-Profile Helix Radiating a Circularly Polarized Wave," IEEE Trans. Antennas Propag., vol. 39, no. 6, pp. 754-757, June 1991.

[4] H. T. Hui, K. Y. Chan, and E. K. N. Yung, "The Low-Profile Hemispherical Helical Antenna With Circular Polarization Radiation Over a Wide Angular Range," IEEE Trans. Antennas Propag., vol. 51, no. 6, pp. 1415-1418, June 2003.

[5] A. H. Safavi-Naeini and O. Ramahi, "Miniaturizing the Axial Mode Helical Antenna," in Proc. IEEE Conf. Communications and Electronics, ICCE, June 2008, pp. 374-379.

[6] I. Ghoreishian and A. Safaai-Jazi, "A New Doubly Helical Antenna," Micro. Opt. Technol. Lett., vol. 57, no. 10, pp. 2351-2355, October 2015.

[7] T. A. Latef and S. K. Khamas, "Measurement and Analysis of a Helical Antenna Printed on a Layered Dielectric Hemisphere," IEEE Trans. Antennas Propag., vol. 59, no. 12, pp. 4831-4835, December 2011.

[8] W. Coburn, C. Ly, T. Burcham, R. Harris, and A. Bamba, "Design and Fabrication of an Axial Mode Helical Antenna," Appl. Comput. Electromagn. Soc. J., vol. 24, no. 6, pp. 559-566, December 2009.

[9] W. Lee, Y.-K. Hong, J. Lee, D. Gillespie, K. G. Ricks, F. Hu, and J. Abu-Qahouq, "Dual-polarized Hexaferrite Antenna for Unmanned Aerial Vehicle (UAV) Applications," IEEE Antennas Wireless Propag. Lett., vol. 12, pp. 765-768, 2013.

[10] W. Lee, Y.-K. Hong, M. Choi, H. Won, J. Lee, G. LaRochelle, and S. Bae, "Figure of Merit of W-type BaCo1.4Zn0.6Fe16027 Hexaferrite for Gigahertz Device Applications," IEEE Magn. Lett., vol. 8, p. 5109204, 2017.

[11] W. Lee, Y.-K. Hong, J. Park, G. LaRochelle, and J. Lee, "Low-loss Z-type Hexaferrite ($Ba3Co_2Fe24041$) for GHz Antenna Applications," J. Magn. Magn. Mater., vol. 414, pp. 194-197, September 2016.

[12] S. Ahn and H. Choo, "A systematic design method of on-glass antennas using mesh-grid structures," IEEE Trans. Veh. Technol., vol. 59, no. 7, pp. 3286-3293, 2010.

[13] S. Ahn, Y. Cho, and H. Choo, "Diversity on-glass antennas for maximized channel capacity for FM radio reception in vehicles," IEEE Trans. Antennas Propag., vol. 59, no. 2, pp. 699-702, February 2011.

[14] G. Byun, Y. G. Noh, I. M. Park, and H. S. Choo, "Design of rear glass-integrated antennas with vertical line optimization for fm radio reception," Int. J. Automotive Technol., vol. 16, no. 4, pp. 629-634, August 2015.

[15] W. Kang and H. Choo, "Design of vertical lines for vehicle rear window antennas," Microw. Opt. Technol. Lett., vol. 52, no. 6, pp. 1445-1449, June 2010.

[16] Y. Noh, Y. Kim, and H. Ling, "Broadband on-glass antenna with meshgrid structure for automobiles," Electron. Lett., vol. 41, no. 21, pp. 1148-1149, October 2005.

[17] G. Byun, C. Seo, B.-J. Jang, and H. Choo, "Design of aircraft on-glass antennas using a coupled feed structure," IEEE Trans. Antennas Propag., vol. 60, no. 4, pp. 2088-2093, April 2012

[18] S. Ahn, S. Park, Y. Noh, D. Park, and H. Choo, "Design of an On-glass Vehicle Antenna Using a Multiloop Structure," Microw. Opt. Technol. Lett., vol. 52, no. 1, p. 107, 2010.

[19] Y. Bai, W. Zhang, L. Qiao, and J. Cao, "Engineering Soft Magnetic Properties by Doping Ions in Low-filed M-type Hexaferrite with Bi-Co-Ti substitution," RSC Adv., vol. 5, p. 91382, 2015.

[20] J. Lee, Y.-K. Hong, S. Bae, J. Jalli, and G. S. Abo, "Low loss $Co_2Z$ (Ba3Co2Fe24O41)-glass Composite for Gigahertz Antenna Application," J. Appl. Phys., vol. 109, p. 07E530, 2011.

[21] C. A. Balanis, Antenna Theory: Analysis and Design, 3rd ed., Hoboken, N.J.: John Wiley & Sons, 2005.

What is claimed is:

1. An antenna comprising:

a multi-shell ferrite-dielectric composite structure comprising:

a hollow-center ferrite layer defining a core of the composite structure;

a plurality of ferrite layers and a plurality of dielectric layers configured in an alternating fashion, wherein a first dielectric layer of the plurality of dielectric layers surrounds the hollow-center ferrite layer; and a radiator comprising a conductor placed in proximity to the composite structure to form the antenna with the composite structure;

wherein the plurality of dielectric layers are configured to reduce lossy characteristics of the plurality of ferrite layers.

2. The antenna of claim 1, wherein the conductor of the radiator is helically wounded around the composite structure, wherein the composite structure forms a single shell, wherein the hollow-center ferrite layer defines a single shell core, and wherein an outer surface of the single shell comprises a shell one of the plurality of as the dielectric layers.

3. The antenna of claim 2, wherein the composite structure and radiator forms an axial-mode helical antenna.

4. The antenna of claim 2, further comprising:

a substrate, wherein the substrate comprises a quarter-wave transmission line, wherein the radiator is configured to be electrically coupled to the quarter-wave transmission line.

5. The antenna of claim 4, wherein the substrate comprises a material selected from the group consisting of plastic, glass-reinforced epoxy laminate sheets, glass-reinforced hydrocarbon/ceramic laminates, glass microfiber reinforced PTFE composite, and a glass having permeability higher than 1.

6. The antenna of claim 1, wherein the composite structure forms a multi-shell composite structure, wherein the multi-shell composite structure comprises a first shell member comprising a first ferrite layer being the ferrite layer surrounded by a first dielectric electric layer being the dielectric layer, and wherein the multi-shell composite structure comprises a second shell member comprising a second ferrite layer surrounded by a second dielectric layer, wherein the second shell member surrounds the first shell member.

7. The antenna of claim 6, wherein the multi-shell composite structure comprises one or more additional N shell members each comprising a ferrite layer surrounded by a dielectric layer, wherein at least one of the one or more additional N shell members surrounds the second shell member.

8. The antenna of claim 1, wherein the conductor of the radiator comprises a meandered copper strip, wherein the composite structure comprises a first glass layer as the dielectric layer, wherein the first glass layer is planar, or generally planar to form the shape of an automotive window, wherein the first glass layer is in contact with the ferrite layer, and the antenna further comprises a second glass layer placed over the meandered copper strip.

9. The antenna of claim 1, wherein each dielectric layer has a first shape and each ferrite layer has a second shape, wherein the first shape is different from the second shape.

10. The antenna of claim 1, wherein each ferrite layer is in contact with a corresponding dielectric layer.

11. The antenna of claim 1, wherein each dielectric layer forms an air gap with a corresponding ferrite layer.

12. The antenna of claim 1, wherein a second dielectric layer is located between each dielectric layer and corresponding ferrite layer.

13. The antenna of claim 1, wherein each ferrite layer comprises a material selected from the group consisting of a spinel ferrite, a hexagonal ferrite, a ferrite composite, and a soft magnetic material having permeability higher than 1.

14. The antenna of claim 1, wherein each dielectric layer comprises a material selected from the group consisting of acrylonitrile butadiene styrene, polyactic acid, polyvinyl alcohol, glass, an organic material having permittivity higher than 1, an inorganic material having permittivity higher than 1, and a metallic material having permittivity higher than 1.

15. The antenna of claim 1, wherein the composite structure has a shape selected from the group consisting of a cylinder, a cone, a sphere, a cuboid, a triangular prism, a pyramid, and a triangular-based pyramid, a hexagonal prism, a polygonal prism, and a polygonal pyramid.

16. The antenna of claim 1, wherein the hollow-center ferrite layer has a dielectric loss tangent (tan δε) of at most 0.08.

17. An axial-mode helical antenna, comprising;

a composite structure comprising:

a hollow-center ferrite layer defining a core of the composite structure;

a plurality of ferrite layers and a plurality of dielectric layers configured in an alternating fashion, including a first dielectric layer, wherein the first dielectric layer of the plurality of dielectric layers surrounds the hollow-center ferrite layer; and a radiator comprising a conductor that helically wound around the composite structure;

wherein the plurality of dielectric layers are configured to reduce collective lossy characteristics of the plurality of ferrite layers.

18. A meandered dipole antenna, comprising;

A composite structure comprising:

a hollow-center ferrite layer defining a core of the composite structure;

a plurality of ferrite layers and a plurality of dielectric layers configured in an alternating fashion, including a first dielectric layer, wherein the first dielectric layer of the plurality of dielectric layers surrounds the hollow-center ferrite layer;

a radiator comprising a meandered conductor, wherein the radiator is placed next to the first dielectric layer; and a second dielectric layer, wherein the first dielectric layer and second dielectric layer encapsulates the radiator;

wherein the plurality of dielectric layers are configured to reduce collective lossy characteristics of the plurality of ferrite layers.

19. A method to configure an antenna, the method comprising:

providing a lossy hollow-center ferrite core for the antenna;

placing a first dielectric layer of a plurality of dielectric layers to surround the lossy hollow-center ferrite core to form an antenna core, wherein the first dielectric layer has a dielectric loss tangent (tan δε) less than that of the lossy hollow-center ferrite core; and placing a plurality of ferrite layers and the plurality of dielectric layers in an alternating fashion around the antenna core;

assembling a conductive radiator for the antenna in proximity to the antenna core, wherein the lossy hollow-center ferrite core, the plurality of dielectric layers, the plurality of ferrite layers, and conductive radiator form the antenna, and wherein the plurality of dielectric layers reduces collective lossy characteristics of the lossy hollow-center ferrite core.

* * * * *